United States Patent [19]

Meistrick

[11] Patent Number: 4,592,319

[45] Date of Patent: Jun. 3, 1986

[54] ENGINE RETARDING METHOD AND APPARATUS

[75] Inventor: Zdenek S. Meistrick, Bloomfield, Conn.

[73] Assignee: The Jacobs Manufacturing Company, Bloomfield, Conn.

[21] Appl. No.: 763,962

[22] Filed: Aug. 9, 1985

[51] Int. Cl.[4] ..... F02D 13/04

[52] U.S. Cl. ..... 123/321; 123/348; 123/90.12; 123/90.16; 123/198 DB

[58] Field of Search ..... 123/321, 347, 348, 90.12, 123/90.13, 90.16, 90.17, 198 DB

[56] References Cited

U.S. PATENT DOCUMENTS

| | | | |
|---|---|---|---|
| 2,178,152 | 10/1939 | Walker | 123/321 |
| 2,785,668 | 3/1957 | Dehmer | 192/3 |
| 3,220,392 | 11/1965 | Cummins | 123/321 |
| 3,367,312 | 2/1968 | Jonsson | 123/321 |
| 3,405,699 | 10/1968 | Laas | 123/321 |
| 3,547,087 | 12/1970 | Siegler | 123/321 |
| 3,786,792 | 1/1974 | Pelizzoni et al. | 123/90.16 |
| 3,809,033 | 5/1974 | Cartledge | 123/90.46 |
| 3,859,970 | 1/1975 | Dreisin | 123/90.12 |
| 4,000,756 | 1/1977 | Ule et al. | 137/596.17 |
| 4,009,695 | 3/1977 | Ule | 123/90.13 |
| 4,054,156 | 10/1977 | Benson | 137/630.12 |
| 4,150,640 | 4/1979 | Egan | 123/90.12 |
| 4,174,687 | 11/1979 | Fuhrmann | 123/90.13 |
| 4,271,796 | 6/1981 | Sickler | 123/321 |
| 4,392,459 | 2/1982 | Chareire | 123/21 |
| 4,398,510 | 8/1983 | Custer | 123/90.16 |
| 4,399,787 | 8/1983 | Cavanagh | 123/321 |
| 4,473,047 | 9/1984 | Jakuba et al. | 123/323 |
| 4,485,780 | 12/1984 | Price et al. | 123/321 |

FOREIGN PATENT DOCUMENTS

| | | |
|---|---|---|
| 114028 | 6/1926 | Switzerland . |
| 307753 | 6/1930 | United Kingdom . |
| 737353 | 1/1955 | United Kingdom . |

*Primary Examiner*—William A. Cuchlinski, Jr.
*Attorney, Agent, or Firm*—Donald E. Degling

[57] ABSTRACT

Process and apparatus for the compression release retarding of a multi-cylinder four cycle internal combustion engine are provided. The process provides a compression release event and a bleeder event or a second compression releaser event for each engine cylinder during each complete engine cycle while employing only one intake valve opening per engine cycle. In accordance with one embodiment of the invention the normal motion of the exhaust valve is disabled and replaced with an opening of the exhaust valve at about the top dead center position of the engine piston following the compression stroke; maintaining the exhaust valve in the open position during the expansion stroke; partially closing the exhaust valve during the exhaust stroke; and fully closing the exhaust valve during the intake stroke. In accordance with another embodiment of the invention, the normal intake valve opening is delayed and the normal motion of the exhaust valve is disabled and replaced with an opening of the exhaust valve at about the top dead center position of the engine piston following the compression stroke; maintaining the exhaust valve in the open position during the expansion stroke; closing the exhaust valve at the end of the expansion stroke; and opening the exhaust valve briefly at about the next top dead center position of the engine piston. The apparatus includes hydraulic and mechanical means to disable or delay the exhaust and intake valves and hydraulic, mechanical and electrical means to manipulate the exhaust and intake valves as required to perform the process.

17 Claims, 13 Drawing Figures

TWO COMPRESSION RELEASE EVENTS PER ENGINE CYCLE

TYPICAL VALVE OPENING SCHEDULE

ENGINE RETARDING METHOD AND APPARATUS

BACKGROUND OF THE INVENTION

1. Field of the Invention

This invention relates generally to an improved engine retarding method and apparatus of the compression release type. More particularly, the invention relates to a compression release retarding system for a four-cycle internal combustion engine which provides one compression release event and one bleeder event or two compression release events during each two revolutions of the engine crankshaft while utilizing only one intake valve opening event and at least partially disabling the normal exhaust valve opening event.

2. Prior Art

The problem of providing adequate and reliable braking for vehicles, particularly large tractor trailer vehicles, is well known. When such vehicles are operating at normal highway speeds they possess a very large momentum, and this may be increased substantially when the vehicle is required to negotiate a long decline. While the normal drum or disc type wheel brakes are capable of absorbing a large amount of energy over a short period of time, the absorbed energy is transformed into heat which rapidly raises the temperature of the braking mechanism to a level which may render ineffective the friction surfaces and other parts of the mechanism. As repeated use of the wheel brakes under these conditions is impracticable, resort has been made to auxiliary retarding devices.

Such auxiliary devices include hydraulic or electrodynamic retarding systems wherein the kinetic energy of the vehicle is transformed by fluid friction or magnetic eddy currents into heat which may be dissipated through appropriate heat exchangers. Other auxiliary systems include exhaust brakes which restrict the flow of air through the exhaust system and compression release retarder mechanisms wherein the energy required to compress the intake air during the compression stroke of a four cycle engine is dissipated by opening the exhaust valve near the end of the compression stroke so that the compressed air is exhausted during the expansion stroke of the engine. With respect to the engine compression release retarder, a portion of the kinetic energy of the vehicle is dissipated through the engine cooling system while another portion of the kinetic energy is dissipated through the engine exhaust system.

A principal advantage of the engine compression release retarder and the exhaust brake over the hydraulic and electrodynamic retarders is that both of the latter retarders require dynamos or turbine equipment which may be bulky and expensive in comparison with the mechanism required for the usual exhaust brake or engine compression release retarder. A typical engine compression release retarder is shown in the Cummins U.S. Pat. No. 3,220,392 while an exhaust brake is disclosed in Benson U.S. Pat. No. 4,054,156. A form of retarder that incorporates certain of the characteristics of the compression release retarder with those of the exhaust brake is known as the bleeder brake. In this mechanism, the exhaust or intake valves (or both) are maintained in a partially open position during the braking mode so that the engine consumes energy during pumping of the air through the partially open valves. Bleeder brakes are disclosed in the Siegler U.S. Pat. No. 3,547,087 and Jonsson U.S. Pat. No. 3,367,312. Other forms of compression release retarders are disclosed in Cartledge U.S. Pat. No. 3,809,033, Pelizzoni et al. U.S. Pat. No. 3,786,792 and Dreisin U.S. Pat. No. 3,859,970.

Since the advent of the Cummins Pat. No. 3,220,392 improvements have been made in various aspects of its operation while maintaining the same mode of operation, i.e., one compression release event for every two crankshaft revolutions. Such improvements include: a mechanism to prevent excess motion of the slave piston (Laas U.S. Pat. No. 3,405,699); a mechanism to prevent excess pushtube loading (Sickler U.S. Pat. No. 4,271,796); a mechanism to advance the opening of the exhaust valve during retarder operation (Custer U.S. Pat. No. 4,398,510; Price et al. U.S. Pat. No. 4,485,780); a mechanism to open only one of the exhaust valves during retarding (Jakuba et al. U.S. Pat. No. 4,473,047); and a mechanism to close the exhaust valve promptly after the compression release event (Cavanagh U.S. Pat. No. 4,399,787).

More recently, and in response to increased fuel costs and more stringent requirements with respect to air pollution, engine operating speeds have been decreased and the engine tuning specifications have been modified both of which adversely affect the performance of the engine retarder. In application Ser. No. 728,947, now U.S. Pat. No. 4,572,114 assigned to the assignee of the present application, a method and apparatus are disclosed by which two compression release events are produced during each two revolutions of the crankshaft for each engine cylinder. In accordance with this method, both the exhaust and intake valves are disabled from opening at the times required for the powering mode of engine operation. Means are provided to open the exhaust valve close to each top dead center (TDC) position of the piston and additional means are provided to open the intake valves during the ensuing expansion stroke as the piston moves toward the bottom dead center (BDC) position thereby providing an intake valve event corresponding to each compression release event. By providing two compression release events for each cylinder during every two revolutions of the crankshaft, the retarding horsepower developed by the engine can be increased substantially.

SUMMARY OF THE INVENTION

In accordance with the present invention, a method and apparatus are provided in a compression release retarding system to increase the retarding horsepower without substantially increasing the flow of air through the turbocharger. This is accomplished by at least partially disabling the exhaust valve from opening at its normal time and opening the exhaust valve at about the top dead center (TDC) position to produce a compression release event. The exhaust valve is held open until bottom dead center position in order to charge the cylinder with air from the exhaust manifold. At the ensuing bottom dead center position, the exhaust valve is then partially closed so as to provide a bleeder brake function until the intake valve partially opens in its normal fashion. Alternatively, the exhaust valve is fully closed near the bottom dead center position to permit compression of the charge of air from the exhaust manifold and reopened briefly near the next top dead center position. In either alternative, the exhaust valve will be closed shortly after the intake valve starts to open so as to permit a fresh charge of air to be drawn into the engine and compressed for use in the next compression release event. Where the exhaust valve is controlled by a fuel injector pushtube driven by a long dwell cam, a mechanism to increase the volume of the hydraulic system used to open the exhaust valve is provided, thereby allowing the exhaust valve to close partially in order to achieve the bleeder effect or to close fully in case of two compression release events. Where the exhaust valve is controlled by another exhaust valve pushtube or by an injector pushtube driven by a short dwell cam, a check valve means is included in the hydraulic circuit provided to open the exhaust valve in order to maintain the exhaust valve in the open position and a mechanism to increase the volume of the hydraulic circuit and/or a vent valve are provided to partially or fully close the exhaust valve. Where two compression release events are employed it is also necessary to delay the normal opening of the intake valve. A mechanism to accomplish this may conveniently be incorporated into the intake valve rocker arm adjusting screw. The mechanism for disabling the normal exhaust valve motion may be incorporated into the exhaust valve pushtube, the rocker arm adjusting screw, rocker arm, rocker arm shaft or crosshead.

DESCRIPTION OF THE DRAWINGS

Further objects and advantages of the invention will become apparent from the following detailed description of the invention and the accompanying drawings in which.

DETAILED DESCRIPTION OF THE INVENTION

The present invention is intended to be employed with an internal combustion engine having a normal four stroke cycle where the four strokes are an intake stroke, a compression stroke, a power or expansion stroke and an exhaust stroke. Preferably, the engine will be of the compression ignition type. In such engines, the valves and fuel injectors are commonly driven through a valve train comprising rotating cams which activate pushtubes or pushrods which, in turn, oscillate rocker arms. If the engine is equipped with dual valves, the rocker arm activates a crosshead which, in turn, opens the valves. The compression release retarder mechanism may be driven from the fuel injector pushtube for the cylinder in question or from an exhaust or intake valve associated with another engine cylinder.

Figure 1:
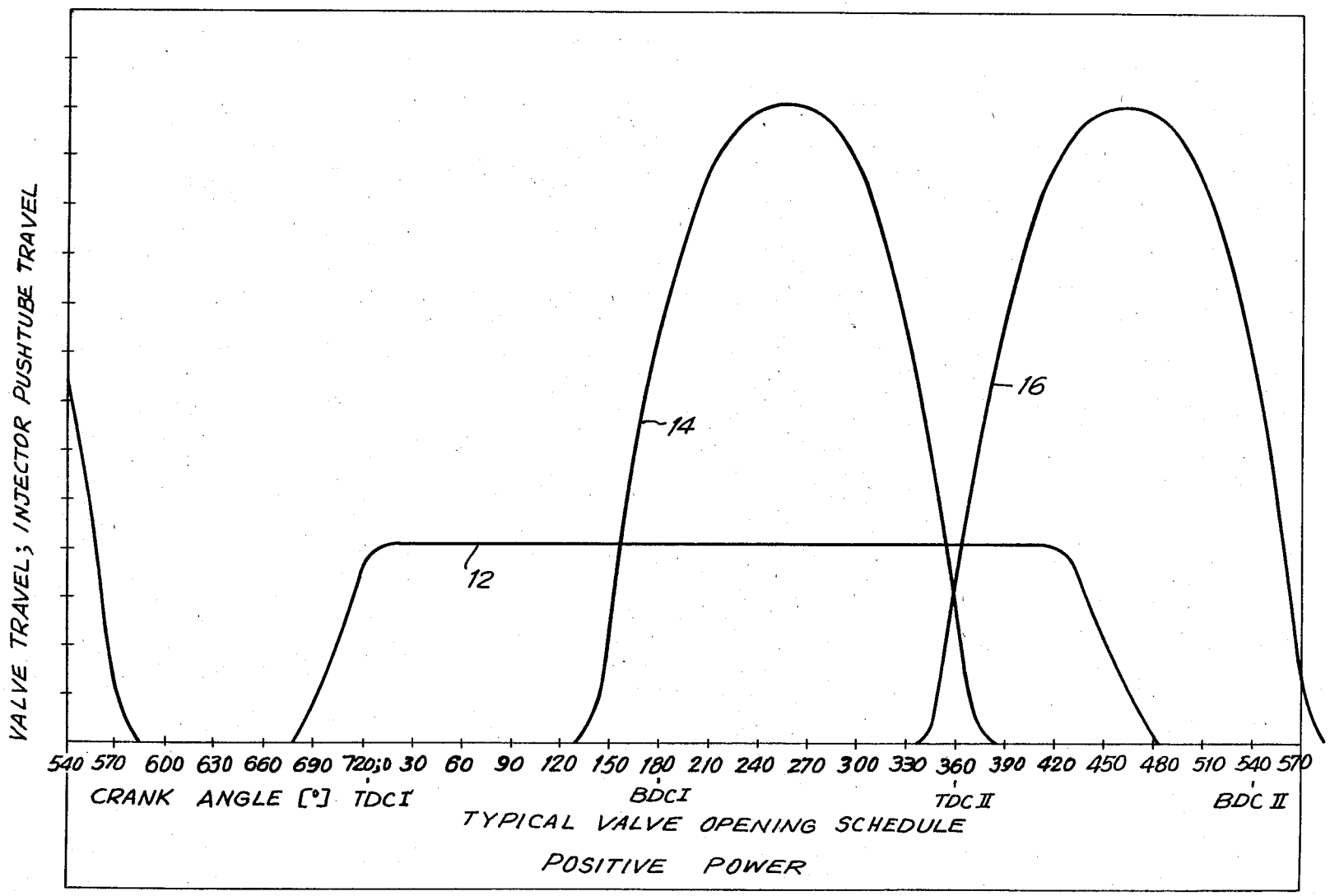
FIG. 1 PRIOR ART
FIG. 1 is a diagram showing the motion of the exhaust valve, intake valve and fuel injector pushtube during a complete engine cycle under positive power conditions.

Reference is now made to FIG. 1 which shows the typical motion of the exhaust valve, intake valve and fuel injector pushtube for a compression ignition engine during positive power operating conditions. The schematic represents the valve opening schedule during one complete engine cycle of 720 crankangle degrees or two crankshaft revolutions. As shown, the engine piston moves between the bottom dead center (BDC) position and the top dead center (TDC) position in 180 crankangle degrees. For convenience, the 0° crankangle position is designated as "TDC I" while the 360° crankangle position is designated as "TDC II." Similarly, the 180° and 540° crankshaft positions are designated as "BDC I" and "BDC II," respectively. Curve 12 represents the motion of the fue injector pushtube for an engine having a long dwell fuel injector cam. As shown by curve 12, the fuel injector is fully seated shortly after TDC I and remains seated until well after TDC II.

FIG. 1 illustrates the operation of a standard four cycle engine wherein the power or expansion stroke occurs between 0° and 180° of crankshaft rotation, the exhaust stroke occurs from 180° to 360°, the intake stroke occurs from 360° to 540°, and the compression stroke occurs from 540° to 720°.

Curve 14 represents the normal power motion of an exhaust valve whie curve 16 represents the normal power motion of an intake valve. It will be noted that the operations of the exhaust and intake valves overlap so that during a brief period both valves are partially open.

Figure 2:
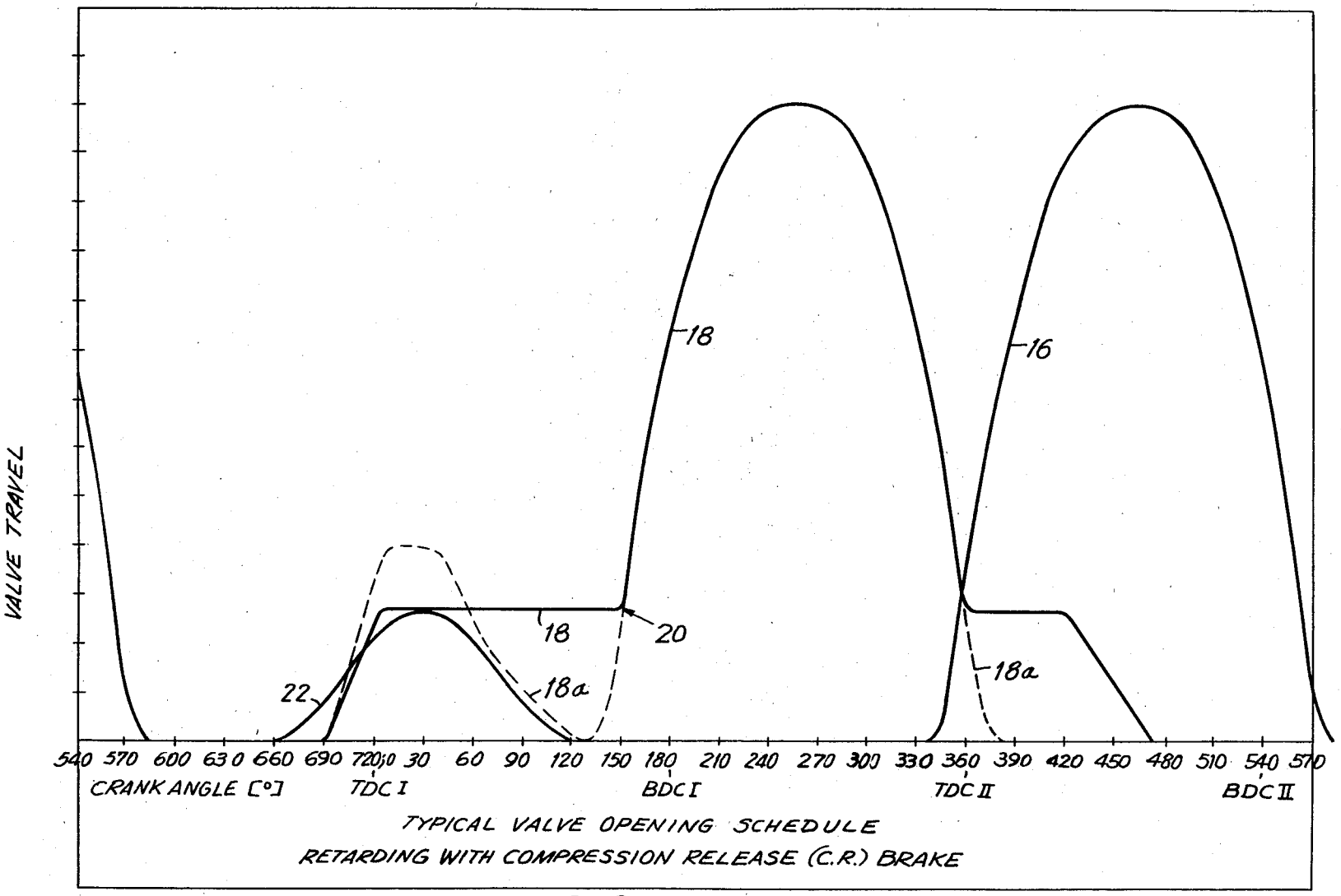
FIG. 2 PRIOR ART
FIG. 2 is a diagram showing the motion of the exhaust and intake valves during a complete engine cycle under retarding conditions in accordance with several prior art configurations.

FIG. 2 illustrates a modification of the exhaust valve operation which occurs with various forms of the compression release retarder. Curve 16 shows the motion of the intake valve which remains unchanged. During the retarding mode of operation, the motion of the fuel injector pushtube may be employed to partially open the exhaust valve or the dual exhaust valves near TDC I so as to dissipate the energy stored in the air compressed in the engine cylinder and produce a compression release event. Curve 18 (solid line) shows the motion of the dual exhaust valves produced by the injector pushtube motion (between about 690 and 150 crankangle degrees and again between about 370 and 470 crankangle degrees) and the additional opening motion produced by the exhaust valve pushtube (between about 150 and 370 crankangle degrees).

When the engine compression retarder opens only one of the dual exhaust valves, in order to minimize the stress on the exhaust valve crosshead resulting from the impact of the exhaust valve rocker arm on the crosshead as indicated by point 20 on curve 18 of FIG. 2, reset mechanisms as described in Cavanagh U.S. Pat. No. 4,399,787 and Mayne et al. U.S. Pat. No. 4,423,712 have been developed. With such mechanisms the exhaust valve can be closed as shown by curve 18*a* prior to its normal opening by the exhaust valve cam.

As noted above, the exhaust valve may be opened near TDC I to produce a compression release event by using the motion of a pushtube associated with an intake or exhaust valve for another engine cylinder when such motion occurs at an appropriate time. Curve 22 (FIG. 2) represents the motion of the exhaust valve derived from the motion of a pushtube associated with the exhaust valve of another cylinder of the engine.

Figure 3A:
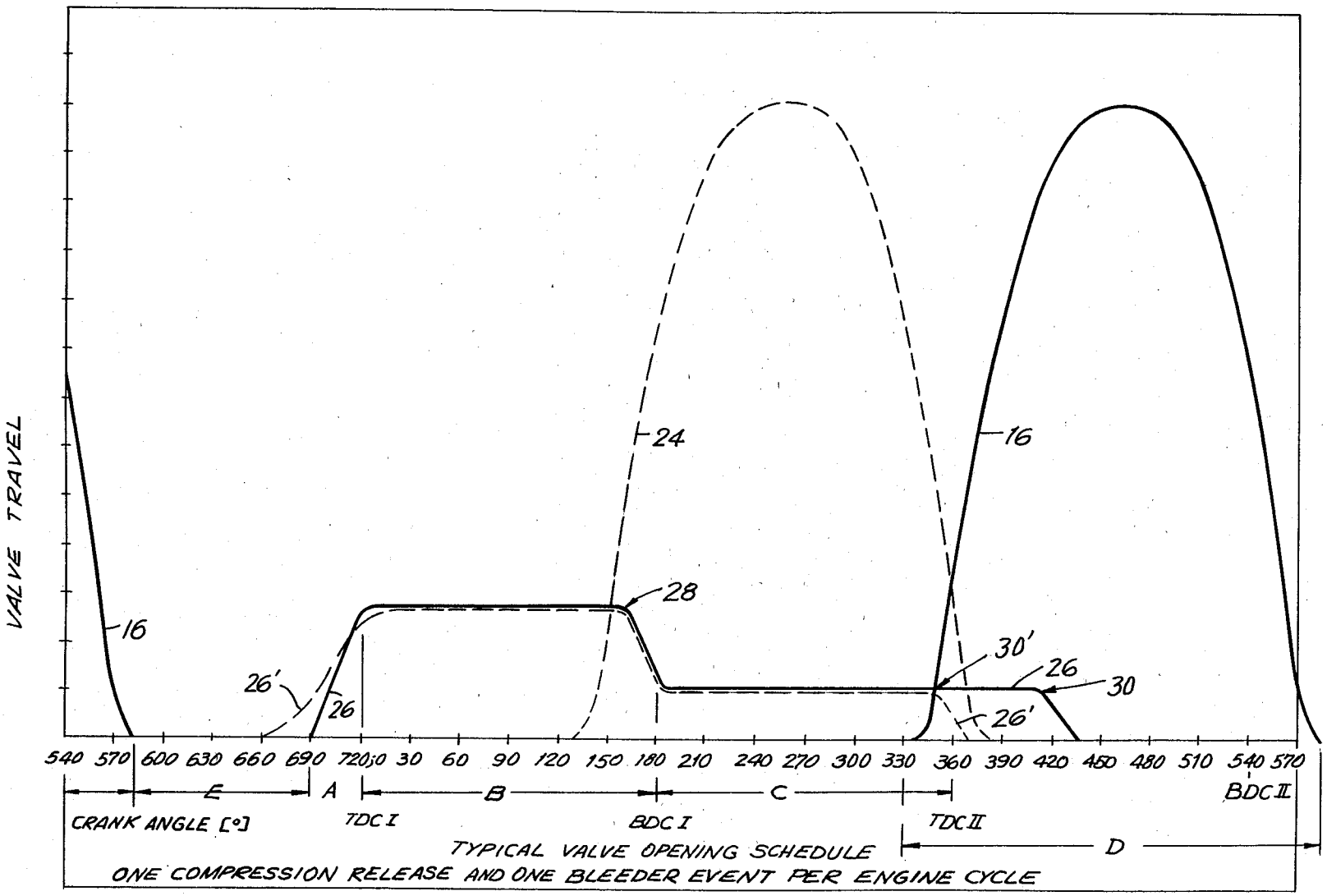
FIG. 3A is a diagram showing the motion of the exhaust valve and intake valve during a complete engine cycle under retarding conditions in accordance with the present invention so as to produce one compression release event and one bleeder event wherein the retarding mechanism is driven by the fuel injector pushtube (curve 26) or an exhaust valve pushtube (curve 26') and the fuel injector pushtube is driven by a long dwell cam.

Reference is now made to FIG. 3A which illustrates embodiments of the process of the present invention as applied to an engine fitted with a modified compression release retarder driven from the fuel injector pushtube, and wherein the fuel injector is driven by a long dwell cam, or a retarder driven from a remote exhaust valve pushtube. Curve 16 represents the motion of the intake valve and is identical to curve 16 on FIGS. 1 and 2. Curve 24 is shown in dashed lines to indicate what the motion of the exhaust valve would be were it not disabled during the retarding mode of operation in accordance with the present invention.

Curve 26 (solid line) illustrates one motion of the exhaust valve according to the present invention. It will be noted that the initial portion of curve 26 corresponds to the motion derived from the fuel injector pushtube (curve 12 of FIG. 1). At point 28 a mechanism described in detail below causes the exhaust valve to move partway to the closed position. At point 30 the exhaust valve begins to close further in response to the movement of the fuel injector pushtube.

Curve 26' (dashed line) shows an aternative motion of the exhaust valve when the compression release retarder is driven from a remote exhaust valve pushtube instead of the fuel injection pushtube. Again, point 28 indicates the point where a mechanism described below causes the exhaust valve to move partway to the closed position. At point 30', a mechanism described below (FIG. 4C) causes the exhaust valve to close completely.

The effect of the valve motions outlined above is as follows: In the period designated as "A" on FIG. 3A which comprises the latter portion of the compression stroke, the exhaust valve opens to cause a compression release event whereby the compressed air is released to the engine exhaust manifold. During the period designated as "B" on FIG. 3A, the air flow through the exhaust valve is reversed due to the motion of the engine piston toward BDC I which increases the cylinder volume. The cylinder is thereby charged with air at low pressure from the exhaust manifold. Near BDC I the exhaust valve opening is substantially reduced so as to provide only a small orifice. As the piston moves from BDC I to TDC II during the period designated "C" on FIG. 3A, substantial work is done on the air charged into the cylinder during the previous stroke. The work in compressing the air and exhausting it through the slightly open exhaust valve represents a dissipation of energy analogous to that which occurs in the bleeder type retarder. During the period designated as "D" on FIG. 3A, a fresh charge of air is introduced into the cylinder from the engine turbocharger compressor while in the period designated "E" on FIG. 3A this fresh charge of air is being compressed.

It will, therefore, be understood that in accordance with this form of the present invention two retarding events occur in each cylinder during each engine cycle comprising two crankshaft revolutions: the first retarding event is a compression release event occurring near TDC I while the second event is a bleeder retarding event occurring while the piston moves from BDC I to TDC II.

Figure 3B:
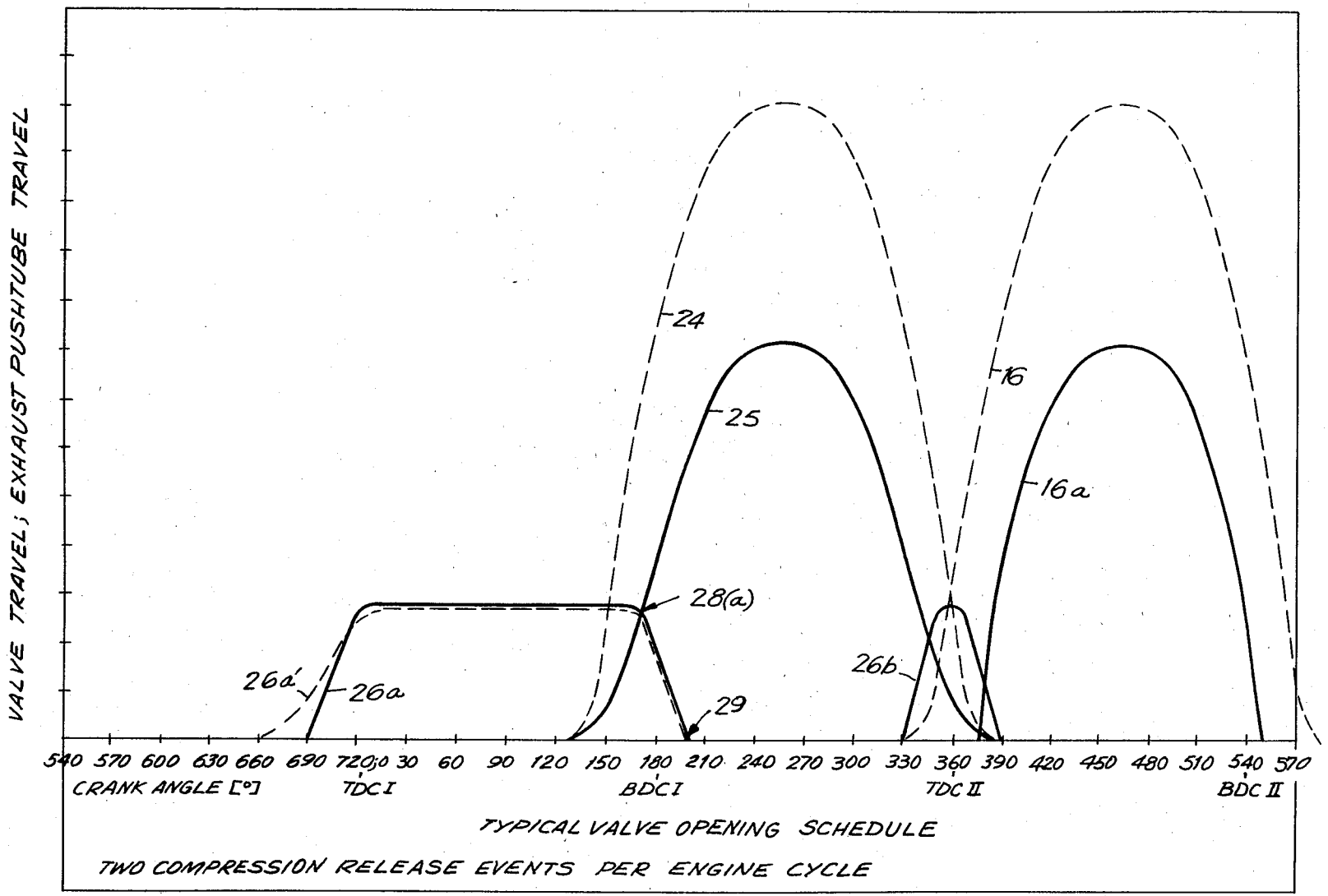
FIG. 3B is a diagram showing the motion of the exhaust valve, exhaust valve pushtube and intake valve during a complete engine cycle under retarding conditions in accordance with the present invention so as to produce two compression release events wherein the retarding mechanism is driven by the fuel injector pushtube (curve **26*a*) or exhaust valve pushtube (curve 26*a'***) and the fuel injector pushtube is driven by a long dwell cam.

FIG. 3B illustrates, schemetically, an alternative process in accordance with the present invention in which the bleeder event is replaced by a second compression release event. Curve 24 is identical to curve 24 of FIG. 3A. Curve 26*a* is identical to curve 26 of FIG. 3A up to the point 28 while curve 26*a'* is identical to curve 26' of FIG. 3A up to the point 28. At point 28 the exhaust valve begins to close and is completely closed at point 29 at or shortly after BDC I. Curve 26*b* represents a brief second opening of the exhaust valve near TDC II. Curve 16*a* represents a modification of the intake valve motion shown by curve 16 of FIG. 3A (and shown in dashed lines on FIG. 3B). The modification comprises a delay in the opening of the intake valve so as to accommodate the second compression release event.

It will be understood that the process as shown by FIG. 3B is similar to that shown in FIG. 3A except that the two retarding events are both compression release events.

The mechanism used to perform the process illustrated in FIG. 3A will be described in conjunction with FIG. 4A which illustrates, diagrammatically, an internal combustion engine 32 having an oil sump 34 which may, if desired, be the engine crankcase and a retarder housing 36. As is common in commercial engines of the Diesel type which are equipped with compression release retarders, each cylinder is provided with two exhaust valves 38 which are seated in the head of the engine 32 so as to communicate between the combustion chamber and the exhaust manifold (not shown) of the engine.

Each exhaust valve 38 includes a valve stem 40 and is provided with a valve spring 42 which biases the valve 38 to the normally closed position. A unitary crosshead and slave piston 258 (hereafter "crosshead") is mounted for reciprocating motion in a direction parallel to the axes of the valve stems 40. The crosshead 258 is provided with an adjusting screw 48 which registers with the stem 40 of one of the valves 38 to enable the crosshead 258 to be adjusted so as to act upon both valves simultaneously.

The unitary crosshead and slave piston 258 which functions to disable the exhaust valve during retarding will be described in more detail hereafter with reference to FIGS. 5A and 5B. If it is desired to employ separate crosshead and slave piston means as illustrated and described, for example, in Cavanagh U.S. Pat. No. 4,399,787 or Price et al. U.S. Pat. No. 4,485,780, an exhaust valve disabling mechanism described below with reference to FIGS. 6A and 6B may be employed.

The crosshead 258 is activated by an exhaust valve rocker arm 50 mounted for oscillatory motion on the head of the engine 32. Such oscillatory motion is imparted to the rooker arm 50 by an exhaust pushtube 52 through an adjusting screw 54 threaded into one end of the rocker arm 50 and locked into its adjusted position by a lock nut 56. The pushtube 52 is given a timed longitudinal reciprocating motion by an exhaust valve cam 58 mounted on the engine camshaft 60 which, in turn, is driven from the engine crankshaft (not shown) so as to rotate at half the speed of the engine crankshaft. The mechanisms provided to disable the exhaust valve will be described in connection with FIGS. 5A and 5B, 6A and 6B.

The compression release mechanism comprises at least one solenoid valve 62 and, for each cylinder of the engine, a contro valve 64, a master piston 66 and a slave piston portion of the crosshead 258 together with appropriate hydraulic and electrical auxiliaries as described below.

Figure 4A:
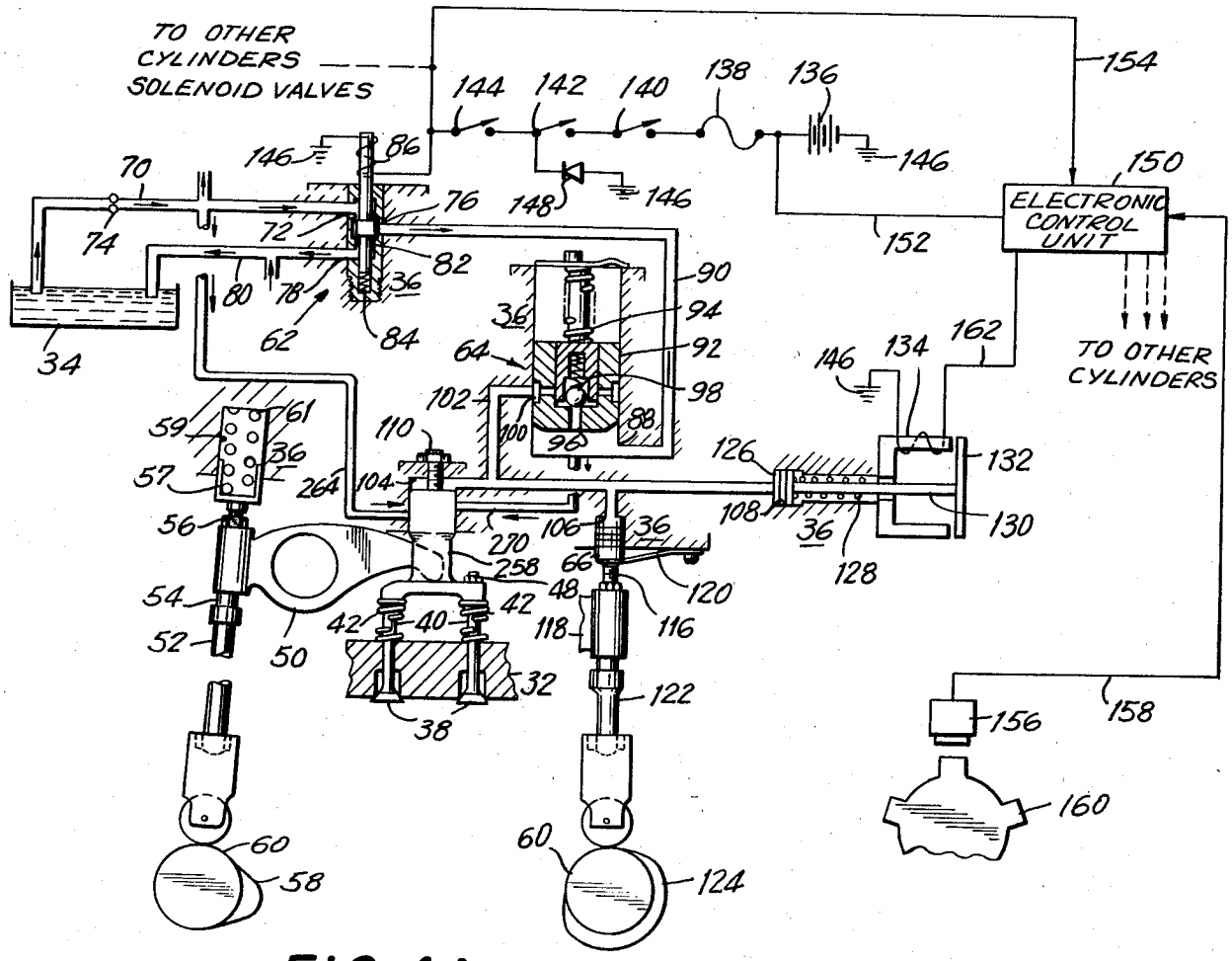
FIG. 4A is a schematic drawing illustrating the mechanical, hydraulic and electrical circuits in accordance with the present invention which produce the motions depicted in FIG. 3A, (curve 26).
Figure 4B:
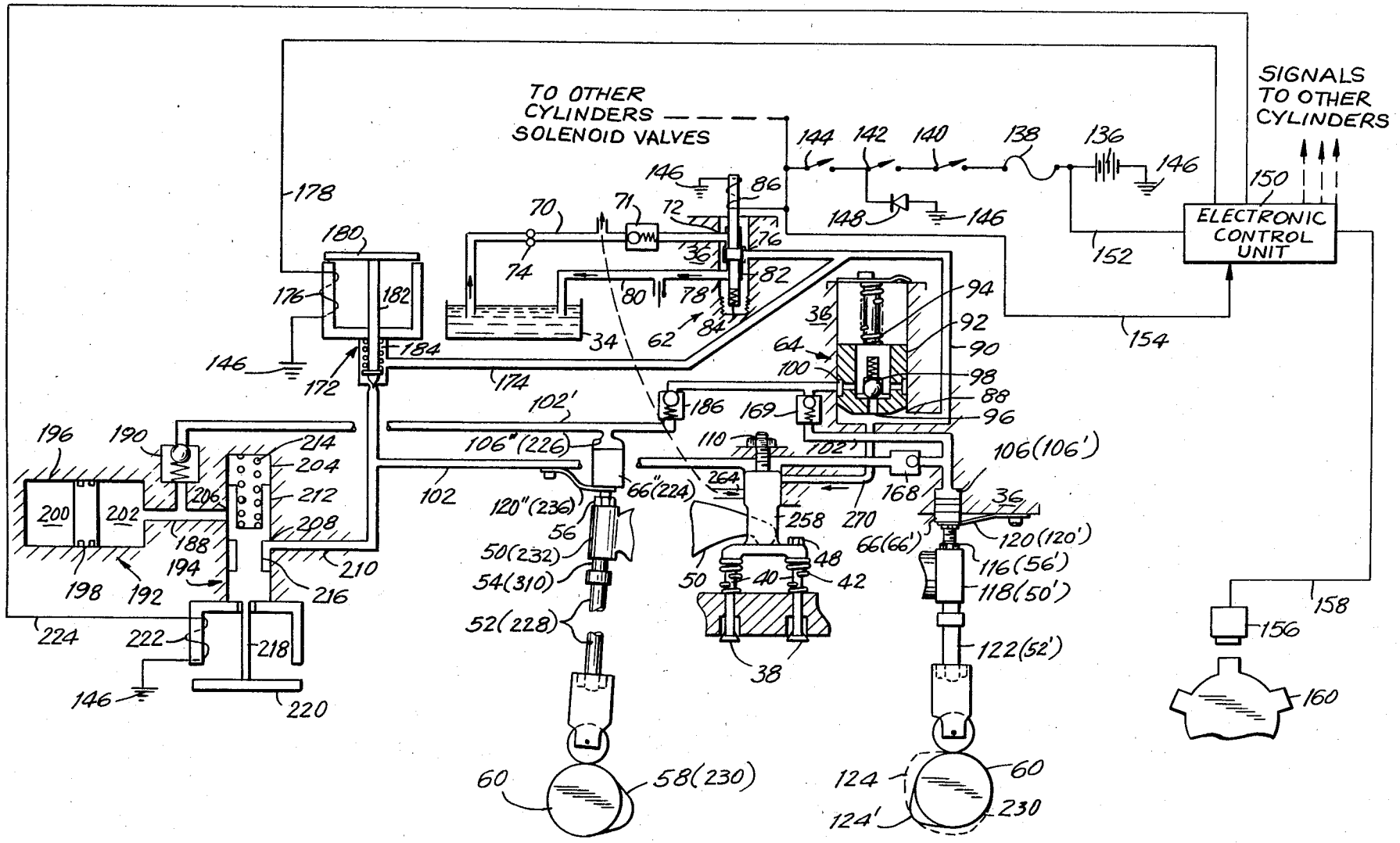
FIG. 4B is a schematic drawing illustrating the mechanical, hydraulic and electrical circuits in accordance with the present invention which produce the motions depicted in FIG. 3B (curve **26*b* and curves 26*a* or 26*a'***).

As shown in FIG. 4A, a low pressure duct 70 communicates between the sump 34 and the inlet port 72 of the solenoid valve 62 located in the housing 36. A low pressure pump 74 may be located in the duct 70 to deliver oil or hydraulic fluid to the inlet port 72 of the solenoid valve 62. If, as shown in FIG. 4B, oil is to be stored within the control valve 64 as disclosed in Cavanagh U.S. Pat. No. 4,399,787, a check valve 71 is located between the pump 74 and the solenoid valve 62. The solenoid valve 62 is a three-way valve having, in addition to the inlet port 72, an outlet port 76 and a return port 78 which communicates back to the sump 34 through a return duct 80. The solenoid valve spool 82 is normally biased by a spring 84 so as to close the inlet port 72 and permit the flow of hydraulic fluid or oil from the outlet port 76 to the return port 78. The solenoid coil 86, when energized, drives the valve spool 82 against the bias of spring 84 so as to close the return port 78 and permit the flow of oil or hydraulic fluid from inlet port 72 to outlet port 76.

The control vave 64, also positioned in the retarder housing 36, has an inlet port 88 which communicates with the outlet port 76 of the solenoid valve through a duct 90. A control valve spool 92 is mounted for reciprocating motion within the control valve 64 and biased toward a closed position by a compression spring 94. The spool 92 is provided with an inlet port 96, normally closed by a spring biased ball check valve 98 and an outlet port 100 formed to include an annular groove on the outer surface of the spool 92. The outlet port 100 of the control valve spool 92 communicates with a duct 102 formed in the retarder housing 36 when the spool 92 is in its open position as illustrated in FIG. 4A. Duct 102 communicates between the control valve 64, slave cylinder 104, master cylinder 106 and volume control cylinder 108, all of which are located in the retarder housing 36. When oil or hydraulic fluid flows into the control valve 64, the spool 92 moves until the outlet port 100 registers with the duct 102. Thereafter, the check valve 98 opens to permit oil or hydraulic fluid to flow through the control valve 64 and into the slave cylinder 104, master cylinder 106 and volume control cylinder 108.

The slave piston portion of the unitary slave piston and crosshead 258 is mounted for reciprocating motion within the slave cylinder 104 and is biased toward the adjustable stop 110 by a compression spring (not shown). A clearance of, for example, 0.018 inch may be provided between the crosshead 258 and the ends of the valve stems 40 when the enqine is cold and the crosshead 258 is seated against the adjustable stop 110.

The master piston 66 is mounted for reciprocating movement within the master cylinder 106. The exterior end of the master piston 66 registers with one end of the adjusting screw mechanism 116 mounted on the fuel injector rocker arm 118. The master piston 66 is lightly biased against the adjusting screw mechanism 116 by a leaf spring 120. The fuel injector rocker arm 118 is driven through a pushtube 122 by a long dwell cam 124 mounted on the camshaft 60.

Mounted for reciprocating motion within the volume control cylinder 108 is a piston 126 which is biased toward the minimum volume position by a compression spring 128. A control pin 130 connects the piston 126 with the armature 132 of solenoid 134. The solenoid 134 provides the holding force to maintain the piston 126 in the minimum volume position. When the solenoid 134 is de-energized, the piston 126 is movable against the bias of spring 128 so as to increase the volume of the hydraulic circuit (which includes the slave cylinder 104 and the master cylinder 106) so as to provide a maximum volume for the hydraulic circuit. By appropriate design of the volume control cylinder 108, the exhaust valve 38 may be held open to any desired extent or closed entirely.

The control circuit comprises, in series, the vehicle storage battery 136, a fuse 138, a manual switch 140, a clutch switch 142, a fuel pump switch 144, the solenoid coil 86 and ground 146. Preferably, a diode 148 is provided between the switches and ground to prevent arcing of the switches. Switches 140, 142, and 144 are provided to permit the operator to shut off the retarder entirely should he desire to do so; to prevent fueling of the engine while the retarder is in operation; and to prevent operation of the retarder if the clutch should be disengaged.

An electronic control unit 150 is powered from the vehicle battery 136 through conduit 152 and engine retarder is activated. The control unit also receives a timing signal from a sensor 156 through conduit 158. Sensor 156 may be located adjacent the engine flywheel 160 or other appropriate engine or retarder component. Solenoid 134 is energized through the electronic control unit 150 through conduit 162 and is normally energized whenever the retarder is activated. However, at point 28 (FIGS. 3A and 3B) which occurs shortly before BDC I, the electronic control unit 150 interrupts the power to the solenoid 134 thereby allowing the solenoid to open and the piston 126 to move so as to increase the volume of the hydraulic circuit. The solenoid 134 is reenergized at some point after BDC I and, preferably, after the exhaust valve closes completely. It will be appreciated that the solenoid 134 is required to close only when no substantial resisting force due to hydraulic circuit pressure is present. When the pressure in the hydraulic circuit is high during the compression release portion of the retarding cycle, the solenoid 134 is required only to hold the armature 132 in the closed position. This occurs at zero or near to zero air gap where the solenoid develops a maximum closing or holding force.

The operation of the system is as follows: When the retarder is actuated by closing switches 140, 142 and 144, the solenoid valve 62 is energized and low pressure oil or hydraulic fluid flows through the solenoid valve 62 and the control valve 64 and into the slave cylinder 104 and master cylinder 106. The oil flowing into the hydraulic circuit is trapped therein by the check valve 98. As the master piston 66 is driven upwardly by the motion of the fuel injector pushtube 122, the hydraulic circuit is pressurized and the unitary slave piston and crosshead 258 is driven downwardly shortly before TDC I. The downward motion of the crosshead 258 moves the valve stems 40 thereby opening the exhaust valves 38 so as to produce a compression release event.

The exhaust valves remain open until shortly before the BDC I position of the piston is reached (e.g., about 160° crankangle position). At this point (point 28, FIG. 3A), the electronic control unit 150 interrupts the power to the solenoid 134 thereby releasing the armature 132 and piston 126. As the piston 126 moves within the volume control cylinder 108, the slave piston portion of the crosshead 258 also retracts and the exhaust valves 38 begin to close. The diameter of the volume control cylinder 108 and the stroke of the piston 126 are selected to produce the desired bleeder opening for the exhaust valves 38.

As noted in FIG. 3A by curve 24, the normal motion of the exhaust valves 38 during the powering mode is disabled during the retarding mode of operation. Mechanisms designed to effect this result are described below in conjunction with FIGS. 5A, 5B, 6A and 6B.

Beginning at about 420 crankangle degrees (e.g., point 30, FIG. 3A), the fuel injector pushtube 122 retracts and thereby permits the master piston 66 to retract and depressurize the hydraulic circuit. Early in the bleeder portion of the cycle, solenoid 134 may be reenergized by the electronic control unit 150. When the hydraulic circuit is depressurized and the solenoid 134 is energized, the combination of solenoid force and the compression spring 128 bias the piston 126 to the minimum volume position thereby returning oil or hydraulic fluid to the hydraulic circuit. Any leakage of hydraulic fluid which may occur may be replenished by flow through the check valve 98 during the low pressure portion of the cycle (i.e., about 465 to about 690 crankangle degrees).

So long as the solenoid valve 62 is energized, the control valve spool 92 will remain in its upward position where the outlet port 100 of the spool is in registry with duct 102. Under these conditions, additional oil or hydraulic fluid may enter the slave cylinder 104 and the master cylinder 106, but reverse flow is prevented. Thus, the high pressure hydraulic circuit is maintained in operating condition and the motion of the master piston 66 will be communicated through the high pressure hydraulic circuit to the crosshead 258.

It will be understood that the cycle of events recited above will be repeated for every two crankshaft revolutions. For each engine cycle comprising two crankshaft revolutions each cylinder will therefore experience one compression release event and one bleeder retarding event.

Reference is now made to curve 26' of FIG. 3A which is a diagram showing the process of the present invention as applied to an engine equipped with a compression release retarder driven by the exhaust pushtube from another engine cylinder or by the fuel injector pushtube where that pushtube is driven by a short dwell cam. In this embodiment of the invention, the compression release event near TDC I can be triggered by a fuel injector or remote exhaust valve pushtube. However, since both of these pushtubes return to the rest position shortly after TDC I, additional means are required to hold the exhaust valve open in order to charge the cylinder from the exhaust manifold for the bleeder retarding event later in the engine cycle. Curve 26' shows the exhaust valve motion required to produce a compression release event near TDC I and a cylinder charge and a subsequent bleeder retarding event between BDC I and TDC II. Curve 22 (FIG. 2) shows the valve motion derived from the exhaust cam for another cylinder used to achieve the compression release event at TDC I. If, instead of using an exhaust valve pushtube to trigger the compression release event at TDC I the fuel injector pushtube were used, the initial portion of curve 26 in FIG. 3A would resemble the initial portion of curve 18 of FIG. 2.

Figure 4C:
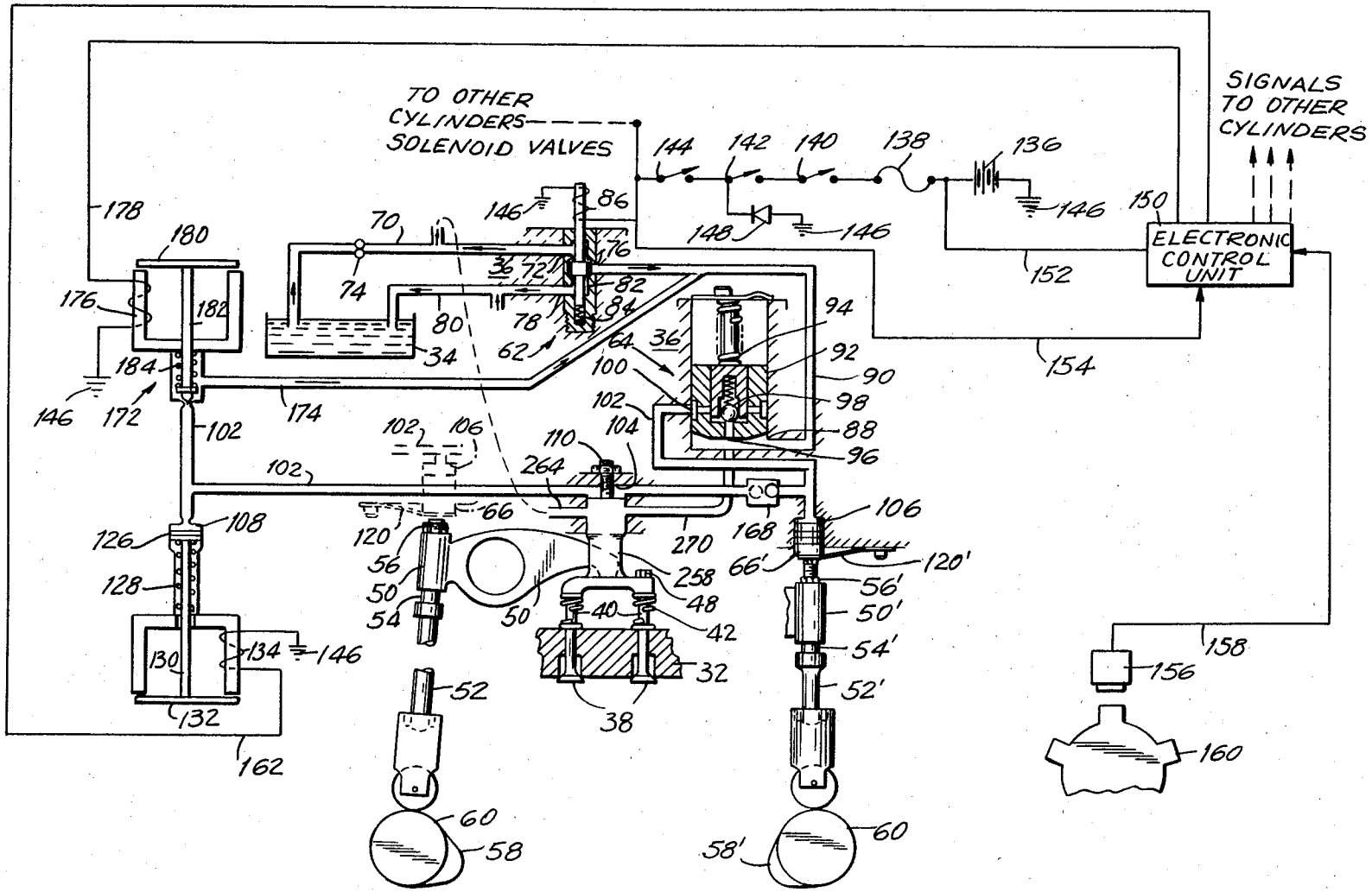
FIG. 4C is a schematic drawing illustrating the mechanical, hydraulic and electrical circuits in accordance with the present invention which produce the motions depicted in FIG. 3A (curve 26').

Reference is now made to FIG. 4C which illustrates schematically the mechanism employed to perform the alternate process shown in FIG. 3A (curve 26'). Parts bearing the same designator in FIGS. 4A and 4C are identical and their description will not be repeated here. Modified parts are designated by a prime (') while alternative parts are shown by dotted lines.

FIG. 4C relates principally to an exhaust driven retarder mechanism wherein the remote exhaust pushtube 52' is driven by a short dwell cam 58' instead of the long dwell cam 124 shown in FIG. 4A. It will be appreciated that when the remote exhaust pushtube 52' is driven by the exhaust cam 58' the master piston 66' will tend to retract before BDC I is reached (see FIG. 2, curve 22). In order to prevent premature retraction of the slave piston portion of the unitary slave piston and crosshead 258, a check valve 168 is located in the duct 102 between master cylinder 106 and slave cylinder 104.

At point 28 on curve 26' of FIG. 3A, the power to the solenoid 134 is interrupted by the electronic control unit 150 thereby permitting the piston 126 to move downwardly (as shown in FIG. 4C) in the volume control cylinder 108. When piston 126 moves downwardly in cylinder 108, the crosshead 258 retracts partially and the exhaust valves approach the closed position. In order to fully close the exhaust valves 38 at or shortly after TDC II, additional oil or hydraulic fluid must be vented from the hydraulic circuit. This is accomplished by means of the solenoid vent valve 172 which communicates between duct 102 and duct 174, which latter duct communicates with duct 90. Solenoid valve 172 comprises a solenoid 176 which is connected to the electronic controller 150 by a conduit 178, an armature 180, a control pin valve 182 and a spring 184 which biases the control valve 182 in sealing relation to duct 102. At or shortly after TDC II (e.g., point 30', FIG. 3A), the electronic control unit 150 interrupts the power to the solenoid 176 permitting the control valve 182 to open and vent oil or hydraulic fluid from duct 102 to duct 174. It will be understood that whenever the pressure in duct 102 between the master cylinder 106 and control valve 64 drops below the pressure in duct 90, oil or hydrauic fuid will pass through the control valve 64 so as to permit full retraction of the master piston and equalization of the pressure in ducts 90, 102 and 174. When the pressures in ducts 102 and 174 are equalized, spring 184 will close the control valve 182. At some point during the intake stroke of the engine the electronic control unit 150 reenergizes the solenoid 176 so as to maintain the control valve 182 in the closed position.

As shown by dashed lines in FIG. 4C a master piston 66 is located over each exhaust valve rocker arm 50. The master pistons 66 will reciprocate in master cylinders 106 which communicate through duct 102 and check valve 168 with the appropriate slave cylinder 104.

It will be appreciated that the solenoid vent valve illustrated in FIG. 4C could also be incorporated into the apparatus shown in FIG. 4A if it were desired to fully close the exhaust valves 38 prior to the return motion of the injector pushtube 122. There would, of course, be no need to provide the check valve 168 in such a revision of the FIG. 4A mechanism.

Reference is now made to FIGS. 3B and 4B which illustrate a process and apparatus whereby two compression release events are produced in each cylinder during each engine cycle which comprises two crankshaft revolutions. Curves or components which are common to both Figures carry the same designation and their description will not be repeated here. Modified or alternative elements will be indicated by a prime or a subscript.

In FIG. 3B, curves 16 and 24 are identical to the corresponding curves in FIG. 3A and the portions of curves 26*a* and 26*a'* up to the point 28*a* are identical to the curves 26 and 26' up to the point 28 in FIG. 3A. Curve 26*a* illustrates an apparatus wherein the compression release event at TDC I is derived from the molion of the injector pushtube 122 while curve 26*a'* illustrates an apparatus wherein the compression release event at TDC I is derived from the motion of a remote exhaust pushtube 52'. In either case, the second compression release event at TDC II (curve 26*b*) is derived from stored high pressure hydraulic fluid. When the compression release event at TDC I is derived from an injector pushtube, the storage function may be derived from the exhaust pushtube or from the intake pushtube. However, if the compression release event at TDC I is derived from a remote exhaust pushtube, the storage function is derived from the intake pushtube.

In FIG. 3B, curve 16 is shown in dashed lines to indicate the motion of the intake valve in the normal powering mode. In accordance with the present invention the motion of the intake valve is delayed by a mechanism shown in FIGS. 7A and 7B until the compression release event at TDC II has occurred. The desired motion of the intake valve is indicated by curve 16*a*. Curve 25 represents the motion of the exhaust valve pushtube 52 which could be used to trigger the motion of the exhaust valve at point 28*a*, if desired. It will be appreciated that even though the exhaust valves are disabled and the intake valves delayed from their normal motion, the pushtubes continue to operate and their motion is employed to actuate the master pistons 66" (or 224) which communicate with the engine retarder hydraulic circuit to provide for the storage function described below.

FIG. 4B illustrates the mechanical, electrical and hydraulic circuits which produce the valve motions shown in FIG. 3B. Parts of FIG. 4B are similar to FIGS. 4A and 4C except that the retarder may be driven either by the fuel injector pushtube 122 (as shown in FIG. 4A) or by a remote exhaust pushtube 52' (as shown in FIG. 4C). As explained more fully below, where the mechanism as shown in FIG. 4B is driven from the fuel injector pushtube 122 or remote exhaust pushtube 52', it makes no difference whether the fuel injector cam is of the long dwell or short dwell type. A long dwell cam is shown by the dashed line 124; remote exhaust and short dwell injector cams are represented by the solid line 124'.

As shown in FIG. 4B, a master cylinder 106" (or 226) and a master piston 66" (or 224) are located in alignment with each exhaust pushtube 52 (or intake pushtube 228) so as to be actuated by the rocker arm adjusting screw mechanism 54 (or 310). The master piston is biased upwardly (as shown in FIG. 4B) by a light leaf spring 120" (or 236). The master cylinder 106" (or 226) communicates via duct 102' through a check valve 186 to duct 102 and the outlet of control valve 64. The other end of duct 102' communicates with duct 188 through a check valve 190. Duct 188 communicates between an accumulator 192 and the inlet of a solenoid actuated spool trigger 194.

The accumulator 192 comprises a cylinder 196 located in the retarder housing 36 containing, for example, a free piston 198 which divides the cylinder into a precharged gas portion 200 and a liquid portion 202. The spool trigger 194 comprises a cylinder 204 located in the retarder housing 36 having an inlet port 206 and an outlet port 208. The inlet port 206 communicates with one end of duct 188 while the outet port 208 communicates via duct 210 with duct 102. A valve spool 212 is mounted for reciprocating motion within the cylinder 204 and biased away from the blind end of cylinder 204 by a compression spring 214. A circumferential groove 216 is formed on the spool 212 which is of sufficient width to communicate with both the inlet port 206 and the outlet port 208 of the cylinder 204 when the spool trigger 194 is actuated but to communicate with only one of the ports 206, 208 when the spool trigger 194 is not actuated.

One end of a control rod 218 is affixed to the valve spool 212 while the other end of the control rod 218 carries the armature 220 of a solenoid 222. The solenoid 222 is energized through the electronic control unit 150 via conduit 224. It will be understood that when the solenoid 222 is energized, the valve spool 212 will be moved against the bias of spring 214 so as to permit flow from duct 188 to duct 210.

Figure 7B:
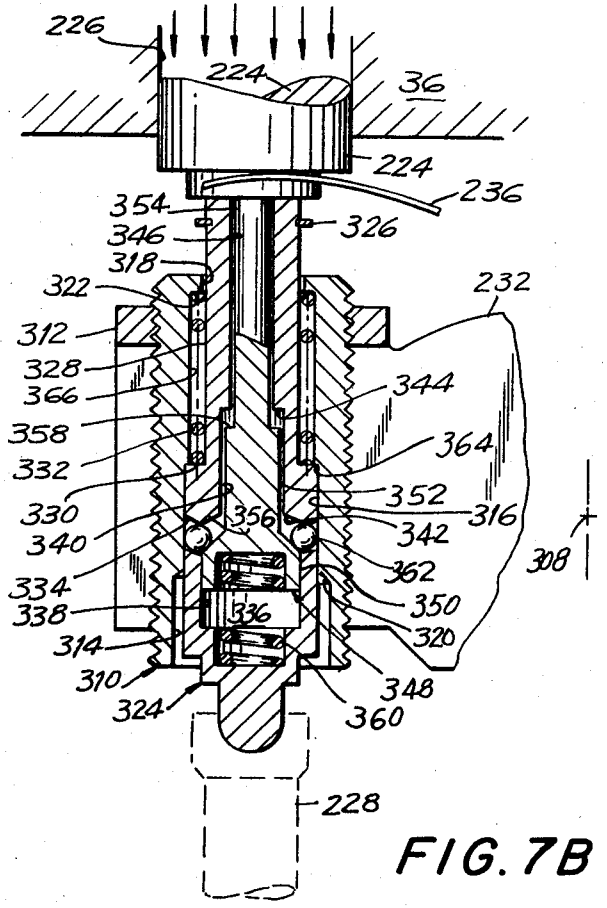
FIG. 7B is a cross-sectional view of the mechanism of FIG. 7A in the retarding mode of operation.
Figure 7A:
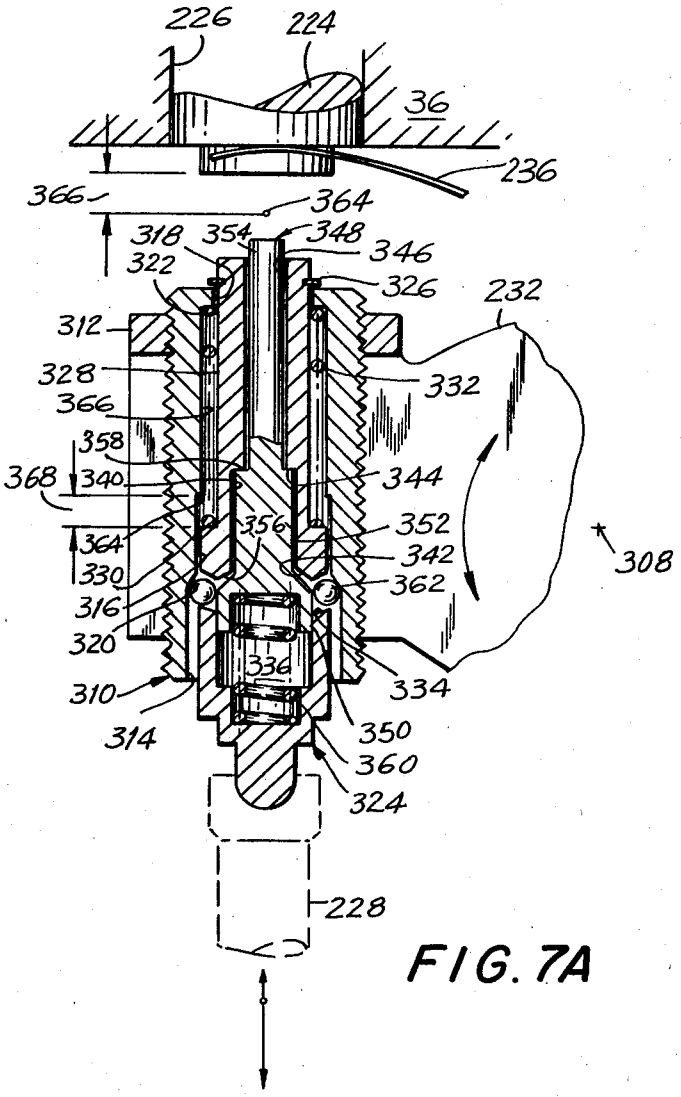
FIG. 7A is a cross-sectional view of a mechanism for delaying the opening of the intake valve and showing the mechanism in the positive powering mode.

It has been noted above that the inlet valve motion is delayed to provide for the second compression release event of the exhaust valve 38. To accomplish this, a master piston 224 is positioned in a master cylinder 226 located in the retarder housing 36 above each intake pushtube 228. The intake pushtube 228 is driven by a cam 230 mounted on the engine camshaft 60. The pushtube 228 oscillates the intake rocker arm 232 through a mechanism comprising an adjusting screw 310, drive pin 324 and actuator pin 348 shown in detail in FIGS. 7A and 7B. The master cylinder 226 communicates with the accumulator 192 through duct 102' and check valve 190. If the intake pushtube 228 is not used to charge the accumulator, the master cylinder 226 may communicate with either the low or high pressure portion of the hydraulic circuit, e.g. duct 90. As shown in FIGS. 7A and 7B, master piston 224 is biased away from the actuator pin 348 by a leaf spring 236. Whenever the retarder is turned on, the master piston 224 moves downwardly (as shown in FIGS. 4B and 7B) to actuate the intake valve delay mechanism.

In operation, actuation of the pushtubes 52 (or 228) will operate the master pistons 66" (or 226) so as to charge the liquid side 202 of the accumulator 192 with hydraulic fluid under pressure. Since the fuel inJector pushtube 122 (or remote exhaust pushtube 52') begins to move just before TDC I it will cause the exhaust valves 38 to open at about TDC I so as to produce a compression release event. Due to the check valve 168, the unitary crosshead 258 will not retract when the master piston 66 (or 66') retracts to follow the downward motion (as shown in FIG. 4B) of the pushtube 122 (or 52'). Due to check valve 169, motion of the master piston 66 (or 66') will not charge the accumulator. However, motion of the pushtubes 52 (or 228) and master pistons 66'' (or 224) will pump hydraulic fluid directly into the accumulator 192 through check valve 190.

The second compression release event, which occurs nears TDC II, can be initiated by a signal from the electronic control unit 150 which energizes the solenoid 222 through conduit 224 and permits a flow of high pressure hydraulic fluid through ducts 210 and 102. Such high pressure fluid actuates the crosshead 258 to open the exhaust valves 38.

The exhaust valves 38 may be closed after each compression release event by interrupting the signal in conduit 178 thereby opening the vent valve 172. It is desirable to store the oil or hydraulic fluid vented from the vent valve 172 under the spool 92 of the control valve 64 as described in the Cavanagh U.S. Pat. No. 4,399,787 which, in its entirety, is incorporated herein by reference. The oil or hydraulic fluid stored within the control valve 64 is returned to the hydraulic circuit through ducts 102 and 102' when the master pistons 66 (or 66')or 66''(or 224) retract. The stored oil or hydraulic fluid is maintained in the hydraulic circuit by check valve 71. It will be understood that it is desirable to deenergize solenoid 222 prior to opening the vent valve 172 in order to avoid a complete discharge of the fluid pressure in the accumulator 192.

It has been noted above that it is necessary to disable the exhaust valves from opening at the time they would normally open during the positive power mode of engine operation. Two mechanisms designed to accomplish this result are disclosed in application Ser. No. 728,947 filed Apr. 30, 1985 and assigned to the assignee of the present invention. One of these mechanisms involves a modification of the exhaust valve crosshead which temporarily prevents actuation of the crosshead by the rocker arm 50 but permits actuation by the slave piston. The other mechanism involves a modification of the rocker arm 50 wherein the portion of the rocker arm which contacts the crosshead is temporarily disconnected from the portion of the rocker arm actuated by the pushtube 52.

A further alternative way to disable the exhaust valve is to provide an eccentric bushing in the rocker arm pivot point so as to raise the pivot or fulcrum and thereby introduce a lost motion in the valve train. Such a device is shown, for example in the Jonsson U.S. Pat. No. 3,367,312, hereby incorporated by reference in its entirety. As noted above, the lost motion mechanisms are also available. See, for example, Pelizzoni U.S. Pat. No. 3,786,792 hereby incorporated by reference in its entirety.

Figure 5A:
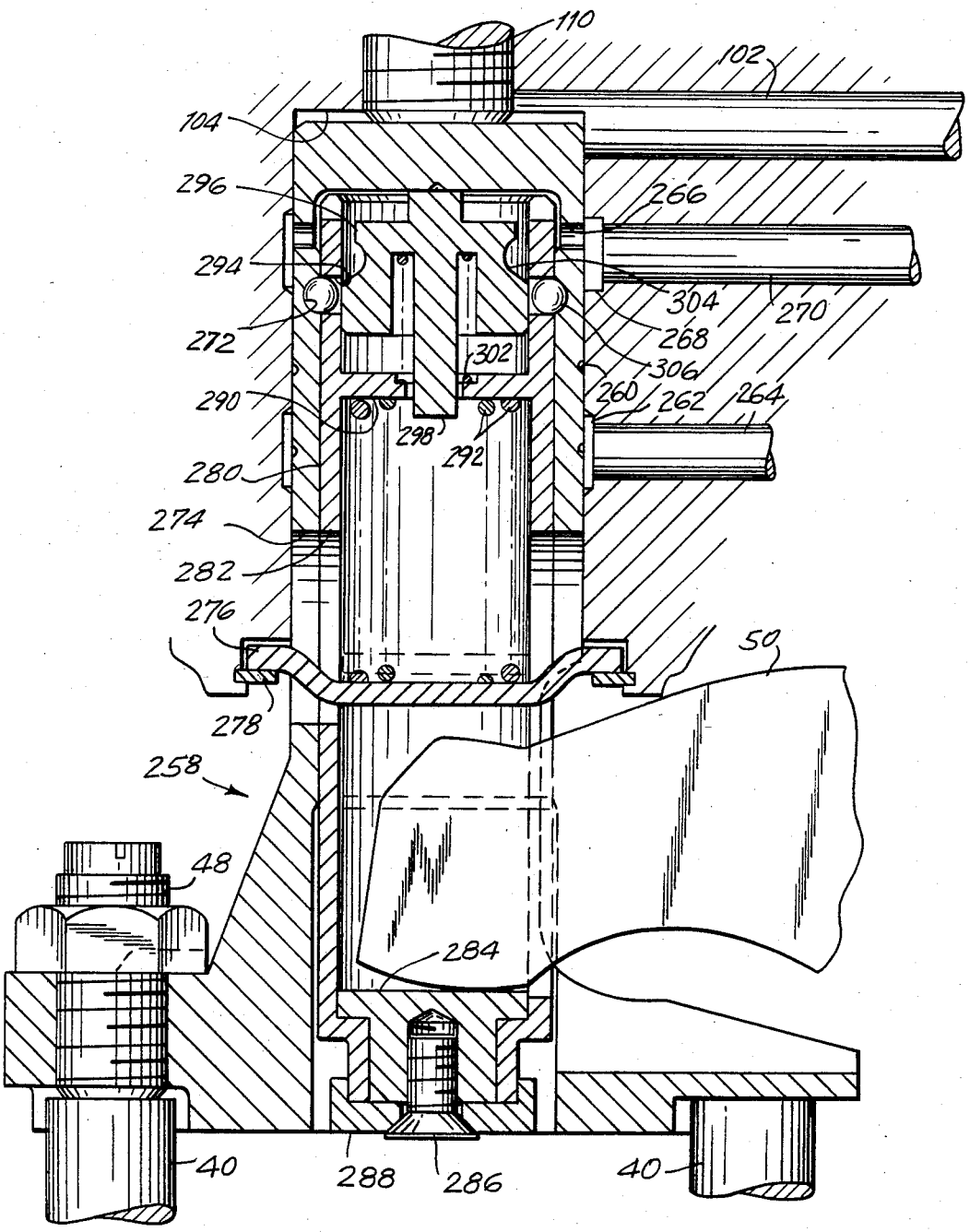
FIG. 5A is a cross-sectional view of a combined slave piston and crosshead mechanism capable of disabling the exhaust valve and showing the mechanism in the positive powering mode.
Figure 5B:
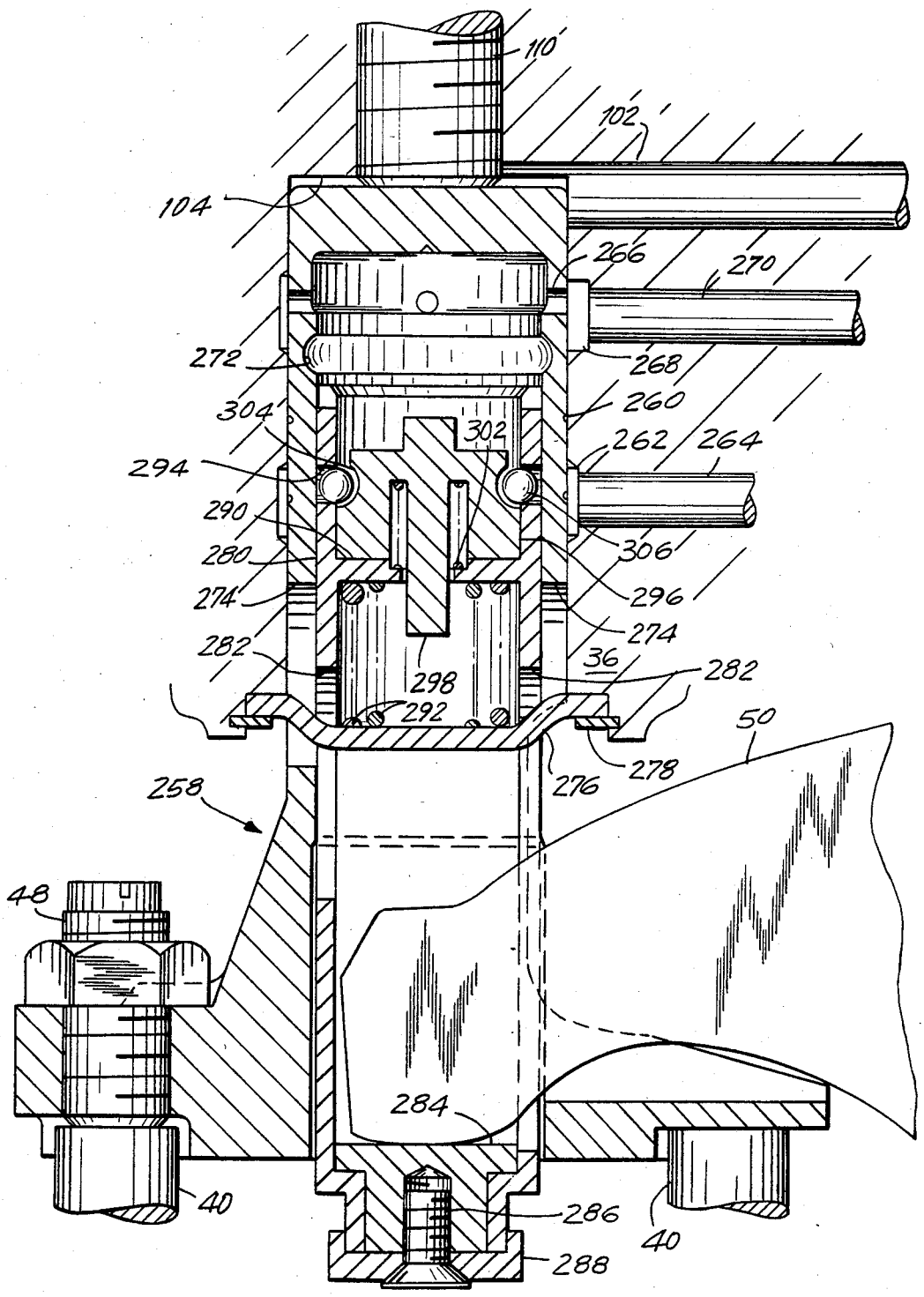
FIG. 5B is a cross-sectional view of the mechanism of FIG. 5A in the retarding mode of operation.

A preferred mechanism for disabling the exhaust valves is shown in FIGS. 5A and 5B which comprises a unitary slave piston and crosshead 258. The unitary slave piston and crosshead 258 is mounted for reciprocating motion in the slave cylinder 104. The slave piston portion is generally tubular in shape but open at the lower end which comprises the crosshead portion. For convenience of lubrication, a series of annular grooves 260 may be formed in the circumferential surface of the slave piston portion of the unitary slave piston and crosshead 258. A circumferential annular channel 262 may also be formed in the slave cylinder 104 which communicates with a lubricating oil duct 264 and the low pressure oil supply duct 70. A series of radial ports 266 is formed through the skirt of the slave piston portion of the unitary structure 258 near the head of the piston portion. When the unitary structure 258 is in its rest position against the adjustable stop 110, the radial ports 266 register with a circumferential channel 268 that communicates through duct 270 with the low pressure feed duct 90 for the control valve 64 (see FIGS. 4A, 4B and 4C). A circumferential raceway 272 is formed on the inner surface of the slave piston portion of the unitary slave piston and crosshead 258 adjacent the radial ports 266. Windows 274 are formed through the slave piston portion of the unitary structure to clear retainer 276 which is positioned in the windows and located by a retainer ring 278 seated in a groove formed in the slave cylinder 104.

A slider 280, generally tubular in shape, is sized to reciprocate within the slave piston portion of the unitary slave piston and crosshead 258. Windows 282 are formed in the slider 280 to register with the windows 274. A rocker arm contact 284 is affixed to the lower portion of the slider 280 by a screw 286 and locking cap 288. The rocker arm contact 284 should be provided with an appropriately hardened surface suitable for activation by the exhaust rocker arm 50. A transverse wall 290 is formed in the slider 280 near the upper end thereof. Slave piston return springs 292 are positioned between the retainer 276 and the transverse wall 290 of the slider 280 to bias the slider 280 upwardly and, in turn, bias the slave piston and crosshead 258 against the adjustable stop 110. A series of radial ports 294 are formed in the upper end of the slider 280 above the transverse wall 290 so as to register with the raceway 272 when the slider 280 is in its uppermost position.

A piston 296 is located within the slider 2B0 above the transverse wall 290. The piston 296 is provided with an axial shaft 298 to guide spring 302 which biases the piston 296 away from the transverse wall 290. The lower circumferential portion of the piston 296 has substantially the same diameter as the inside of the slider 280 within which it can be reciprocated. The upper circumferential portion of the piston 296 is relieved to form a raceway 304. A plurality of balls 306, which may, for example, be ball bearings, is positioned in the series of radial ports 294. The balls 306 have a diameter greater than the wall thickness of the slider 280 so that the balls 306 extend into the raceway 272 and lock the slider 280 and the unitary slave piston and crosshead 258 together. When the slider 280 and the slave piston and crosshead 258 are locked together, oscillation of the rocker arm 50 will result in reciprocation of the crosshead so as to activate the exhaust valves 38.

However, when duct 270 is pressurized as a result of actuation of the solenoid valve 62, piston 296 is forced downwardly against the bias of spring 302 so that the raceway 304 comes into registry with the radial ports 294 and the balls 306 are cammed out of raceway 272 and toward raceway 304. This action unlocks the slider 280 from the unitary slave piston and crosshead 258 so that actuation of the slider 280 by the exhaust rocker arm 50 will not result in opening the exhaust valves 38. However, when duct 102 is pressurized by motion of the master piston 66, the unitary slave piston and crosshead 258 will be activated and the exhaust valves 38 opened.

FIG. 5B illustrates the mechanism of FIG. 5A during the retarding mode of operation wherein the exhaust valves have been disabled by unlocking the slider 280 from the unitary slave piston and crosshead 258. It will be appreciated from FIG. 5B that when the exhaust valves have been disabled by this mechanism the exhaust valve springs 42 have, in effect, been removed from the remainder of exhaust valve train. If the slave piston return spring exerts insufficient force to avoid play in the valve train and maintain contact among the rocker arm, pushtube, cam follower and cam, a supplemental spring mechanism may be provided. Referring to FIG. 4A, a piston 57 may be mounted for reciprocating motion within cylinder 59 located in the retarder housing 36 and aligned with the exhaust pushtube 52. A compression spring 61 biases the piston 57 toward the rocker arm adjusting screw 54 thereby eliminating play in the exhaust valve train. It will, of course, be appreciated that in the mechanisms shown in FIGS. 4B and 4C the function of piston 57 may be performed by the master piston 66" (or 224), respectively.

Figure 6B:
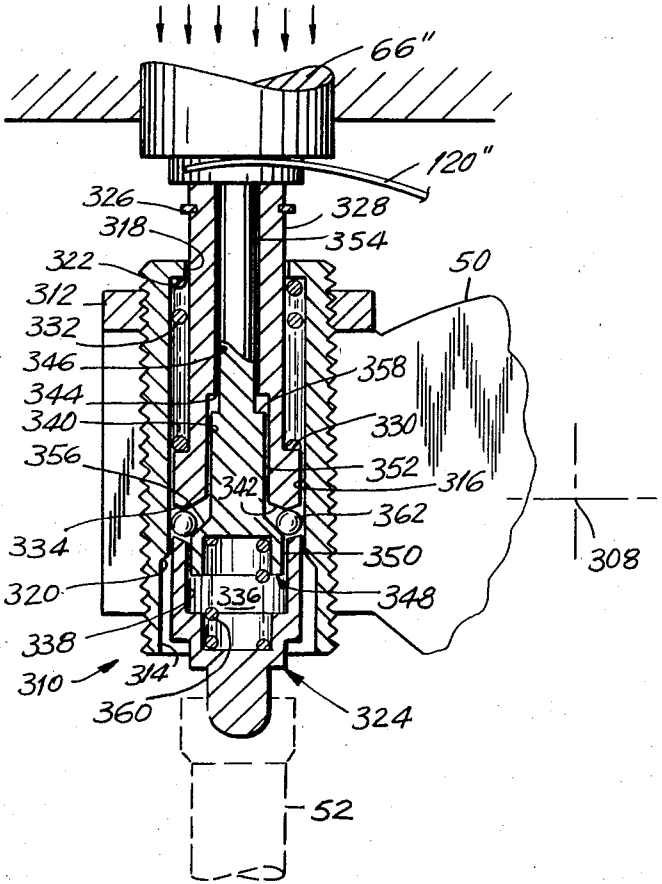
FIG. 6B is a cross-sectional view of the mechanism of FIG. 6A in the retarding mode of operation.
Figure 6A:
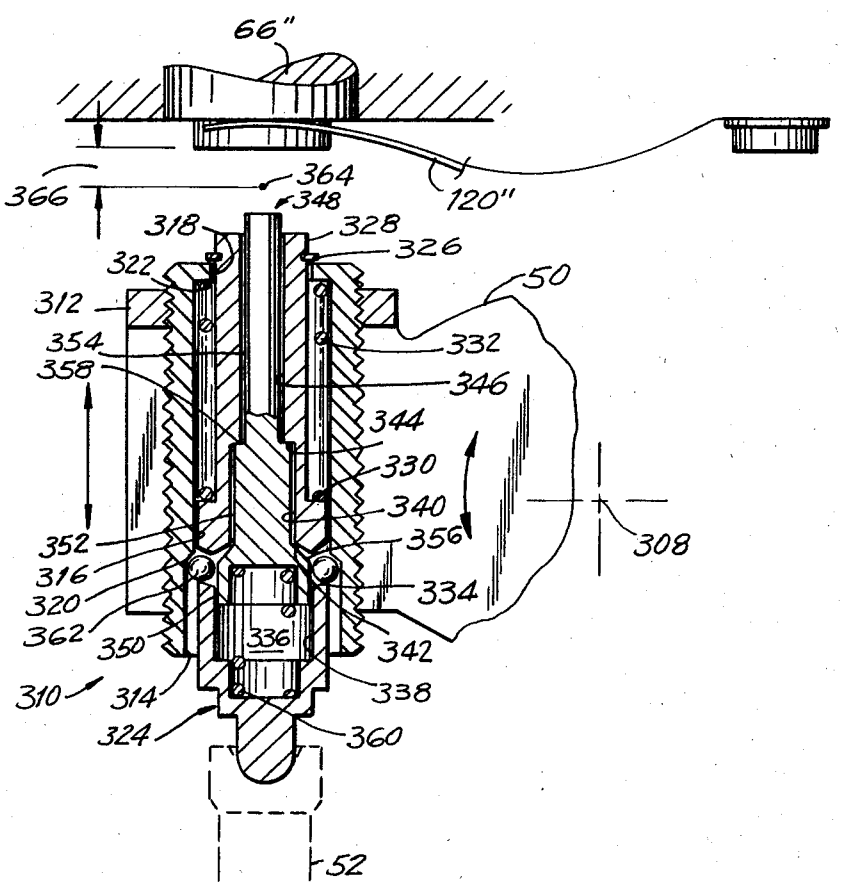
FIG. 6A is a cross-sectional view of an alternative mechanism for disabling the exhaust valve and showing the mechanism in the positive powering mode.

In the event that it is desired to employ separate crossheads and slave pistons in accordance with conventional practice, an alternative exhaust valve disabling mechanism according to the present invention may be used in place of the rocker arm adjusting screw 54 and locknut 56. FIG. 6A shows such a mechanism during the powering mode of engine operation wherein it performs the function of the adjusting screw 54. FIG. 6B shows the same mechanism during the retarding mode of engine operation wherein it disables the rocker arm 50 and, therefore, the exhaust valves 38.

Point 308 represents the point about which rocker arm 50 pivots when actuated by the pushtube 52. The mechanism comprises a tubular adjusting screw 310 which replaces the solid adjusting screw 54 and which is locked in its adjusted position by locknut 312. The tubular adjusting screw is provided with three concentric bores. A large bore 314 extends a short distance from the pushtube end of the adjusting screw 310. An intermediate bore 316 extends from the large bore 316 substantially to the top of the adjusting screw 310. A small bore 318 extends through the top of the adjusting screw 310. A sloping shoulder 320 is formed between the large bore 314 and the intermediate bore 316 while a horizontal shoulder 322 is formed between the intermediate bore 316 and the small bore 318

A drive pin 324 is positioned within the adJusting screw 310. The maximum diameter of the drive pin 324 is slightly less than the diameter of the intermediate bore 316 to permit reciprocation of the drive pin 324 relative to the adjusting screw 310. One end of the drive pin 324 is adapted to mate with, and be driven by, the pushtube 52. A snap ring 326 limits the downward (as shown in FIGS. 6A and 6B) movement of the drive pin 324 relative to the adjusting screw 310. The upper portion of the drive pin 324 has an outside diameter 328 which is slightly smaller than the small bore 318 of the adjusting screw 310 so as to permit relative reciprocation of the drive pin and adjusting screw 310. A shoulder 330 is defined by the diameter 328 of the upper portion of the drive pin 324 and the maximum diameter of the drive pin. A compression spring 332 is located within the adjusting screw 310 between shoulders 322 and 330 so as to bias the drive pin 324 downwardly (as shown in FIGS. 6A and 6B) relative to the adjusting screw 310. A plurality of ports 334 are disposed around the circumference of the drive pin 324 in the region of its largest diameter. The ports 334 are directed angularly downwardly (as shown in FIGS. 6A and 6B) from the outside of the drive pin 324 toward the axis of the drive pin. A stepped cavity 336 is formed within the drive pin 324. The largest diameter 338 of the stepped cavity 336 communicates at its upper region with the plurality of ports 334, and with an intermediate diameter 340 through a sloping shoulder 342. The intermediate diameter 340 terminates at a shoulder 344 while a smaller diameter section 346 extends from the shoulder 344 through the top of the drive pin 324.

A stepped actuator pin 348 is mounted for reciprocating motion with respect to the drive pin 324 and includes a large diameter section 350, an intermediate diameter section 352 and a small diameter section 354. A sloping shoulder 356 joins the larger diameter section 350 and the intermediate diameter section 352 while a horizontal shoulder 358 is located between the intermediate and small diameter sections of the actuator pin 348. When the actuator pin 348 is in its uppermost position (as shown in FIG. 6A) the horizontal shoulder 358 in the actuator pin abuts the shoulder 344 of the drive pin 324 and the small diameter section 354 of the actuator pin 348 extends beyond lhe upper end of the drive pin 324. The actuator pin 348 is biased toward its uppermost position by a compression spring 360 located within the cavity 336. A ball 362 is located in each of the ports 334. The balls 362 are larger in diameter than the wall thickness of the drive pin 324 in the region of the ports 334 so that when the actuator pin is in its uppermost position (as shown in FIG. 6A) the balls 362 extend outside the drive pin 324 and engage the shoulder 320 of the adjusting screw 310. However, whenever the actuator pin 348 is depressed as shown in FIG. 6B, the sloping shoulder 320 cams the balls 362 inwardly so that the balls 362 rest, at least partially, on the sloping shoulder 356 of the actuator pin 348. In this position (FIG. 6B), the balls 362 clear the shoulder 320 and the drive pin 324 is free to reciprocate with respect to the adjusting screw 310.

Point 364 (FIG. 6A) represents the maximum upward excursion of the drive pin 324 as a result of the upward movement of the exhaust valve pushtube 52. The distance 366 (FIG. 6A) represents a clearance (which should be a minimum of about 0.100") between point 364 and the rest position of the master piston 66" (or 224) (FIG. 4B) or 66 (FIG. 4C). The master piston 66" (or 224) is biased toward its rest position by the leaf spring 120" (or 236). Whenever the engine retarder is turned on, the hydraulic circuit will be pressurized by the low pressure pump 74 (FIG. 4A) and the master piston 66" will be driven downwardly (as viewed in FIGS. 6A and 6B) until it contacts the end of the drive pin 324 against the bias of leaf spring 120" and compression spring 360. Under these conditions, the motion of the pushtube 52 will be transmitted through the drive pin 324 to the master piston 66" but the rocker arm 50 will remain at rest since the drive pin 324 will be disengaged from the adjusting screw 310. However, the bias of compression spring 332 will maintain the rocker arm 50 in contact with the exhaust valve crosshead (not shown). It will be seen, therefore, that the exhaust valves 38 are automatically disabled by the mechanism of FIGS. 6A and 6B whenever the engine retarder is switched on.

FIGS. 7A and 7B illustrate a mechanism which is very similar to the mechanism shown in FIGS. 6A and 6B but which is designed to delay but not entirely disable the motion of the intake valve. For purposes of clarity and brevity, parts which are common to both mechanisms carry the same designators. It will be understood, however, that the rocker arm 232 is an intake valve rocker arm, the pushtube 228 is an intake valve pushtube and the master piston 224 is located in alignment with the intake valve pushtube 228 within a master cylinder 226 located in the retarder housing 36.

The only significant difference in the mechanisms shown in FIGS. 7A and 7B over the mechanisms shown in FIGS. 6A and 6B is that an extra step is provided between the intermediate bore 316 and the small bore 318 so as to form a shoulder 364 between the intermediate bore 316 and an intervening bore 366. The diameter of the intervening bore 366 is smaller than the maximum diameter 328 of the drive pin 324. The distance 368 between shoulders 330 and 364 is directly proportional to the delay introduced into the motion of the rocker arm and valve associated therewith. It will be appreciated that any desired delay may be built into the mechanism. When the distance 368 is equal to or greater than the travel of the pushtube 228, the mechanism of FIGS. 7A and 7B will function exactly like the mechanism of FIGS. 6A and 6B.

Although the mechanism of FIGS. 7A and 7B is intended principally to provide the intake valve delay required by FIG. 3B, it will be appreciated that this mechanism may be used whenever a delay in the intake or exhaust valve motion is required. Similarly, the mechanism of FIGS. 6A and 6B may be used whenever the intake or exhaust valves are required to be disabled.

The terms and expressions which have been employed are used as terms of description and not of limitation and there is no intention in the use of such terms and expressions of excluding any equivalent of the features shown and described or portions thereof, but it is recognized that various modifications are possible within the scope of the invention claimed.

What is claimed is:

1. A process for compression release retarding of a cycling multi-cylinder four cycle internal combustion engine having a crankshaft and an engine piston operatively connected to said crankshaft for each cylinder thereof and having intake and exhaust valves for each cylinder thereof comprising, for at least one cylinder thereof, the steps of reducing the flow of fuel to said cylinder, commencing opening the exhaust valve for said cylinder prior to the top dead center position of the said engine piston during an upstroke of the piston corresponding to its compression stroke during normal operation of the engine to produce a compression release event, holding said exhaust valve open during a substantial portion of the ensuing downstroke of said engine piston, disabling said exhaust valve from moving at the point it would move in the cycle during normal operation of the engine, at least partially closing said exhaust valve commencing near to the bottom dead center position of the said engine piston corresponding to its expansion stroke during normal operation of the engine, holding said exhaust valve in the partially closed position during at least the ensuing upstroke of said engine piston corresponding to its exhaust stroke during normal operation of the engine to produce a bleeder retarding event, operating said intake valve as it would move in the cycle during normal operation of the engine, and fully closing said exhaust valve commencing at least early during the ensuing downstroke of said engine piston corresponding to its intake stroke during normal operation of the engine whereby one compression release retarding event and one bleeder retarding event is produced in said one cylinder during each engine cycle comprising two revolutions of said crankshaft.

2. A process as set forth in claim 1 wherein said exhaust valve is returned to its fully closed position during the downstroke of said engine piston corresponding to its intake stroke during normal operation of the engine.

3. A process as set form in claim 1 wherein said exhaust valve is returned to its fully closed position substantially at the top dead center position of said engine piston corresponding to the end of its exhaust stroke during normal operation of the engine.

4. A process as set forth in claim 1 wherein said exhaust valve commences to open for said compression release event at about 30 crankangle degrees before TDC I; the exhaust valve commences to close at least partially for said bleeder retarding event at about 15 crankangle degrees before BDC I and the exhaust valve commences to close fully at about 60 crankangle degrees after TDC II.

5. A process as set forth in claim 1 wherein the exhaust valve commences to open for said compression release event at about 60 crankangle degrees before TDC I, the exhaust valve commences to close at least partially for said bleeder retarding event at about 15 crankangle degrees before BDC I and the exhaust valve commences to close fully at about 15 crankangle degrees before TDC 11.

6. A process for compression release retarding of a cycling multi-cylinder four cycle internal combustion engine having a crankshaft and an engine piston operatively connected to said crankshaft for each cylinder thereof and having intake and exhaust valves for each cylinder thereof comprising for at least one cylinder thereof the steps of reducing the flow of fuel to said engine cylinder, commencing opening the exhaust valve for said cylinder prior to the top dead center position of the said engine piston during an upstroke of the piston corresponding to its compression stroke during normal operation of the engine to produce a first compression release event, holding said exhaust valve open during a substantial portion of the ensuing downstroke of said engine piston, disabling said exhaust valve from moving at the point it would move in the cycle during normal operation of the engine, fully closing said exhaust valve commencing at about the bottom dead center position of the said engine piston corresponding to its expansion stroke during normal operation of the engine, delaying said intake valve from moving at the point it would move in the cycle during normal operation of the engine, commencing reopening said exhaust valve prior to the top dead center position of said engine piston during an upstroke of the piston corresponding to its exhaust stroke during normal operation of the engine to produce a second compression release event, reclosing said exhaust valve during the ensuing downstroke of said engine piston, opening said intake valve during said ensuing downstroke of said engine piston corresponding to its intake stroke during normal operation of the engine and closing said intake valve commencing during said ensuing downstroke of said engine piston corresponding to its intake stroke during normal operation of the engine whereby two compression release retarding events are produced in said one cylinder during each engine cycle comprising two revolutions of said crankshaft.

7. A process as set forth in claim 6 wherein said reclosing of said exhaust valve commences shortly after the top dead center position of said engine piston during a downstroke of the piston corresponding to its intake stroke during normal operation of the engine.

8. A process as set forth in claim 6 wherein the exhaust valve commences to open for said first compression release event at about 30 crankangle degrees before TDC , the exhaust valve commences to close at about 15 crankangle degrees before BDC 1, the exhaust valve commences to reopen for said second compression release event at about 30 crankangle degrees before TDC II, the exhaust valve commences to reclose shortly after TDC II, the intake valve commences to open at about 15 crankangle degrees after TDC II and the intake valve commences to close prior to BDC II.

9. A process as set forth in claim 6 wherein the exhaust valve commences to open for said first compression release event at about 60 crankangle degrees before TDC I, the exhaust valve commences to close at about 15 crankangle degrees before BDC I, the exhaust valve commences to reopen for said second compression release event at about 30 crankangle degrees before TDC II, the exhaust valve commences to reclose shortly after TDC II, the intake valve commences to open at about 15 crankangle degrees after TDC II and the intake valve commences to close prior to BDC II.

10. An engine retarding system of a gas compression release type comprising a multi-cylinder four cycle internal combustion engine having a crankshaft and a camshaft driven in synchronism with said crankshaft, engine piston means associated with said crankshaft, exhaust valve means and intake valve means associated with each cylinder of said engine, pushtube means driven from said camshaft, hydraulic fluid supply means, hydraulically actuated first piston means associated with said exhaust valve means to open said exhaust valve means, second piston means actuated by said first pushtube means and hydraulically interconnected with said first piston means and said hydraulic fluid supply means to open said exhaust valve means during an upstroke of the engine piston associated with said exhaust valve means corresponding to its compression stroke during normal operation of the engine to produce a compression release event, means associated with said pushtube means for holding said exhaust valve open during a substantial portion of the ensuing downstroke of said engine piston, first means responsive to hydraulic pressure supplied by said hydraulic fluid supply means adapted to disable said exhaust valve means from moving at the point it would move in the cycle during normal operation of the engine, third piston means hydraulically interconnecled with said first and second piston means adapted to close at least partially said exhaust valve commencing prior to the bottom dead center position of the said engine piston oorresponding to its expansion stroke during normal operation of the engine and hold said exhaust valve in the partially closed position during at least the ensuing upstroke of said engine piston corresponding to its exhaust stroke during normal operation of the engine to produce a bleeder retarding event, said means associated with said pushtube means further adapted to fully close said exhaust valve commencing at least during the ensuing downstroke of said engine piston corresponding to its intake stroke during normal operation of the engine whereby one compression release retarding event and one bleeder retarding event is produced in such said cylinder during each engine cycle comprising two revolutions of said crankshaft.

11. An engine retarding system of a gas compression release type comprising a multi-cylinder four cycle internal combustion engine having a crankshaft and a camshaft driven in synchronism with said crankshaft, engine piston means associated with said crankshaft, exhaust valve means and intake valve means associated with each cylinder of said engine, pushtube means driven from said camshaft, hydraulic fluid supply means, hydraulically actuated first piston means associated with said exhaust valve means to open said exhaust valve means, second piston means actuated by said pushtube means and hydraulically interconnected with said first piston means and said hydraulic fluid supply means to open said exhaust valve means during an upstroke of the engine piston associated with said exhaust valve means corresponding to its compression stroke during normal operation of the engine to produce a compression release event, check valve means located in the hydraulic circuit between said first piston means and said second piston means for holding said exhaust valve open during a substantial portion of the ensuing downstroke of said engine piston, first means responsive to hydraulic pressure supplied by said hydraulic fluid supply means adapted to disable said exhaust valve means from moving at the point it would move in the cycle during normal operation of the engine, third piston means hydraulically interconnected with said first piston means and adapted to close at least partially said exhaust valve commencing near the bottom dead center position of the said engine piston corresponding to its expansion stroke during normal operation of the engine and hold said exhaust valve in the partially closed position during at least substantially the ensuing upstroke of said engine piston corresponding to its exhaust stroke during normal operation of the engine to produce a bleeder retarding event, and vent valve means hydraulically interconnected with said first piston means adapted to vent pressurized hydraulic fluid from said first piston means to said hydraulic fluid supply means and thereby fully close said exhaust valve commencing at least during the ensuing downstroke of said engine piston corresponding to its intake stroke during normal operation of the engine whereby one compression release retarding event and one bleeder retarding event is produced in each said cylinder during each engine cycle comprising two revolutions of said crankshaft.

12. An engine retarding system of a gas compression release type comprising a multi-cylinder four-cycle internal combustion engine having a crankshaft and a camshaft driven in synchronism with said crankshaft, engine piston means associated with said crankshaft, exhaust valve means and intake valve means associated with each cylinder of said engine, first, second and third pushtube means driven from said camshaft, hydraulic fluid supply means, hydraulically actuated first piston means associated with said exhaust valve means to open said exhaust valve means, second piston means actuated by said first pushtube means and hydraulically interconnected with said first piston means and said hydraulic fluid supply means to open said exhaust valve means commencing during an upstroke of the engine piston associated with said exhaust valve means corresponding to its compression stroke during normal operation of the engine to produce a first compression release event, first check valve means located in the hydraulic circuit between said first piston means and said second piston means for holding said exhaust valve open during a substantial portion of the ensuing downstroke of said engine piston, first means responsive to hydraulic pressure supplied by said hydraulic fluid supply means adapted to disable said exhaust valve from moving at the point it would move in the cycle during normal operation of the engine, hydraulic fluid accumulator and valve means including third piston means associated with said second pushtube means adapted to pump hydraulic fluid under pressure into said accumulator means during the period when the exhaust valve would open during normal operation of the engine, second check valve means located between said third piston means and said accumulator means to prevent reverse flow from said accumulator means, third check valve means located between said third piston means and said second piston means to prevent flow from said third piston means toward said second piston means, vent valve means hydraulically interconnected with said first piston means adapted to vent pressurized hydraulic fluid from said first piston means to said hydraulic fluid supply means and thereby fully close said exhaust valve commencing prior to the bottom dead center position of the said engine piston corresponding to its expansion stroke during normal operation of the engine, means associated with said third pushtube means including fourth piston means responsive to hydraulic pressure supplied by said hydraulic fluid supply means to partially disable said intake valve from moving at the point it would move in the cycle during normal operation of the engine, means hydraulically interconnected with said first piston means and including said accumulator means and said valve means adapted to deliver hydraulic fluid under pressure to commence reopening said exhaust valve prior to the top dead center position of said engine piston during an upstroke of the piston corresponding to its exhaust stroke during normal operation of the engine to produce a second compression release event, said vent valve means hydraulically interconnected with said first piston means adapted to vent pressurized hydraulic fluid from said first piston means to said hydraulic fluid supply means thereby reclosing said exhaust valve during the ensuing downstroke of said engine piston, said means associated with said third pushtube means adapted to open said intake valve during the ensuing downstroke of said engine piston corresponding to the intake stroke during normal operation of the engine and to close said intake valve commencing during said ensuing downstroke of said engine piston corresponding to its intake stroke during normal operation of the engine whereby two compression release retarding events are produced in said one cylinder during each engine cycle comprising two revolutions of said crankshaft.

13. A unitary slave piston and crosshead mechanism for an internal combustion engine equipped with a compression release engine retarder comprising crosshead means adapted to contact the stems of dual exhaust valves, said crosshead means having formed integrally therewith slave piston means adapted to reciprocate within a slave cylinder formed in said compression release retarder, said crosshead means also having formed therein an internal bore, a first circumferential raceway formed in said internal bore, a plurality of first transverse radial ports, and first transverse windows communicating between said bore and the outer surface of said integral slave piston means, tubular slider means positioned within said internal bore for reciprocating movement therein, second transverse window means adapted to register with said slave piston transverse windows, contact means associated with a first end of said slider means, a plurality of second transverse radial ports and a transverse wall formed adjacent the second end of said tubular slider means, retainer means located within said first and second transverse windows and affixed to said slave cylinder, biasing means positioned between said retainer means and first side of said transverse wall, piston means positioned for reciprocation within said tubular slider means in the region between said transverse wall and said second end of said tubular slider means, said piston means having a second circumferential raceway formed thereon, biasing means adapted to bias said piston away from said transverse wall, and locking means loosely located in said radial ports of said tubular slider means and adapted in their locking mode to register with said first circumferential raceway whereby said tubular slider means is locked to said crosshead means, and in their unlocked mode to register with said second circumferential raceway whereby said tubular slider means may reciprocate within said internal bore of said crosshead.

14. A valve disabling mechanism for an internal combustion engine having a valve train mechanism comprising tubular driven means affixed to the valve train mechanism and having first and second shoulder means, tubular drive pin means coaxially disposed within said tubular driven means and communicating at one end with said valve train mechanism, said tubular drive pin means having third and fourth shoulder means and a plurality of transverse radial ports, actuating pin means coaxially disposed within said tubular drive pin means and adapted to reciprocate between first and second positions within said tubular drive pin means, said actuating pin means having fifth and sixth shoulder means, first biasing means interposed between said actuating pin means and said tubular drive pin means and adapted to bias said drive pin means towards said first position, second biasing means disposed between second and third shoulder means and locking means loosely disposed within said transverse radial ports between a first position in engagement with said first shoulder and a second position in engagement with said fifth shoulder.

15. A mechanism as set forth in claim 14 wherein said tubular driven means includes a seventh shoulder intermediate said first and second shoulders engageable with said third shoulder.

16. A mechanism as set forth in claims 14 or 15 wherein said tubular driven means is adjustable with respect to said valve train mechanism.

17. A mechanism as set forth in claims 14 or 15 in which said first and fifth shoulders are sloped in a direction to cam said looking means away from whichever one of said first and fifth shoulders said locking means may be in engagement with.

* * * * *

UNITED STATES PATENT AND TRADEMARK OFFICE

CERTIFICATE OF CORRECTION

PATENT NO. : 4,592,319

DATED : June 3, 1986

INVENTOR(S) : Zdenek S. Meistrick

It is certified that error appears in the above-identified patent and that said Letters Patent is hereby corrected as shown below:

| | |
|---|---|
| Abstract, line 5 | "releaser" should be --release-- |
| Col. 6, line 30 | "28" (second occurrence only) should be --28a-- |
| Col. 8, line 53 | "point 28 (Figs. 3A and 3B) which occurs" should be --point 28 (Fig. 3A) and point 28a (Fig. 3B) which occur-- |
| Col. 11, line 30 | "molion" should be --motion-- |
| Col. 14, line 41 | "2BO" should be --280-- |
| Claim 8, line 4 | "TDC" should be --TDC I-- |
| Claim 10, line 11 | "said first" should be --said-- |
| Claim 14, line 17 | "between second" should be --between said second-- |

Signed and Sealed this

Eighteenth Day of November, 1986

*Attest:*

DONALD J. QUIGG

*Attesting Officer* *Commissioner of Patents and Trademarks*